US011280327B2

(12) United States Patent
Allis et al.

(10) Patent No.: US 11,280,327 B2
(45) Date of Patent: Mar. 22, 2022

(54) MICRO PISTON PUMP

(71) Applicant: Insulet Corporation, Acton, MA (US)

(72) Inventors: Daniel Allis, Boxford, MA (US); Ian McLaughlin, Boxboro, MA (US); Kenneth Phillips, Boston, MA (US)

(73) Assignee: INSULET CORPORATION, Acton, MA (US)

( * ) Notice: Subject to any disclaimer, the term of this patent is extended or adjusted under 35 U.S.C. 154(b) by 120 days.

(21) Appl. No.: 16/054,323

(22) Filed: Aug. 3, 2018

(65) Prior Publication Data

US 2019/0040850 A1 Feb. 7, 2019

Related U.S. Application Data

(60) Provisional application No. 62/699,022, filed on Jul. 17, 2018, provisional application No. 62/540,954, filed on Aug. 3, 2017.

(51) Int. Cl.
*F04B 19/00* (2006.01)
*F04B 1/02* (2006.01)
(Continued)

(52) U.S. Cl.
CPC ..... *F04B 19/006* (2013.01); *F04B 1/02* (2013.01); *F04B 1/047* (2013.01); *F04B 1/0452* (2013.01);
(Continued)

(58) Field of Classification Search
CPC ..... F04B 1/02; F04B 1/0452; F04B 1/047; F04B 7/0026; F04B 7/003; F04B 7/0049;
(Continued)

(56) References Cited

U.S. PATENT DOCUMENTS 1,441,508 A * 1/1923 Jensen ..... F04B 1/02 417/517
2,198,666 A 4/1940 Gruskin
(Continued)

FOREIGN PATENT DOCUMENTS

CA 606281 A 10/1960
CN 1375338 A 10/2002
(Continued)

OTHER PUBLICATIONS

European Search Report and Written Opinion for the European Patent Application No. EP19177571, dated Oct. 30, 2019, 8 pages.
(Continued)

*Primary Examiner* — Charles G Freay
*Assistant Examiner* — Chirag Jariwala
(74) *Attorney, Agent, or Firm* — Kacvinsky Daisak Bluni PLLC

(57) ABSTRACT

A low-force, non-displacement, micro/miniature valve and/or pump assembly is provided. A tube component having a first side port coupled to an inlet portion and a second side port coupled to an outlet portion can be selectively moved to alternatively couple the side ports to a first or second piston pump chamber. First and second pistons can be actuated after positioning the tube component to either draw in fluid or push out fluid from either the first or second piston pump chambers during each actuation of the pistons. The fluid can be drawn in from a reservoir and can be expelled to a patient for providing a dose of the fluid to the patient.

20 Claims, 17 Drawing Sheets

(51) Int. Cl.

| | |
|---|---|
| ***F04B 53/10*** | (2006.01) |
| ***F04B 1/047*** | (2020.01) |
| ***F04B 1/0452*** | (2020.01) |
| ***F04B 7/00*** | (2006.01) |
| ***F04B 9/06*** | (2006.01) |
| ***F04B 19/22*** | (2006.01) |
| ***F04B 23/02*** | (2006.01) |

(52) U.S. Cl.
CPC ..... *F04B 7/003* (2013.01); *F04B 7/0026* (2013.01); *F04B 7/0049* (2013.01); *F04B 7/0053* (2013.01); *F04B 7/0096* (2013.01); *F04B 9/06* (2013.01); *F04B 19/22* (2013.01); *F04B 23/02* (2013.01); *F04B 53/109* (2013.01)

(58) Field of Classification Search
CPC ..... F04B 7/0053; F04B 7/0096; F04B 9/06; F04B 19/006; F04B 19/22; F04B 23/02; F04B 53/109; F04B 9/02; F04B 9/025; F04B 9/04–047; F04B 23/025; F04B 23/04; F04B 23/06; A61M 5/1422; A61M 5/14216; A61M 5/14242; A61M 39/22; A61M 5/00; A61M 5/14; A61M 5/142; F16K 27/041; F16K 31/523
USPC ..... 417/517; 600/432
See application file for complete search history.

(56) References Cited

U.S. PATENT DOCUMENTS 2,752,918 A 7/1956 Uytenbogaar
3,176,712 A 4/1965 Ramsden
3,297,260 A 1/1967 Barlow
3,464,359 A 9/1969 King
3,885,662 A 5/1975 Schaefer
3,946,732 A 3/1976 Hurscham
3,947,692 A 3/1976 Payne
3,993,061 A 11/1976 OLeary
4,108,177 A 8/1978 Pistor
4,152,098 A 5/1979 Moody et al.
4,210,173 A 7/1980 Choksi et al.
4,221,219 A 9/1980 Tucker
4,257,324 A 3/1981 Stefansson et al.
4,268,150 A 5/1981 Chen
4,313,439 A 2/1982 Babb et al.
4,371,790 A 2/1983 Manning et al.
4,417,889 A 11/1983 Choi
4,424,720 A 1/1984 Bucchianeri
4,435,173 A 3/1984 Siposs et al.
4,475,905 A 10/1984 Himmelstrup
4,498,843 A 2/1985 Schneider et al.
4,507,115 A 3/1985 Kambara et al.
4,551,134 A 11/1985 Slavik et al.
4,562,751 A 1/1986 Nason et al.
4,567,549 A 1/1986 Lemme
4,585,439 A 4/1986 Michel
4,601,707 A 7/1986 Albisser et al.
4,634,427 A 1/1987 Hannula et al.
4,671,429 A * 6/1987 Spaanderman ..... A22C 11/02 222/110
4,678,408 A 7/1987 Nason et al.
4,684,368 A 8/1987 Kenyon
4,685,903 A 8/1987 Cable et al.
4,755,169 A 7/1988 Sarnoff et al.
4,766,889 A 8/1988 Trick et al.
4,808,161 A 2/1989 Kamen
4,846,797 A 7/1989 Howson et al.
4,858,619 A 8/1989 Foth
4,898,579 A 2/1990 Groshong et al.
4,908,017 A 3/1990 Howson et al.
4,944,659 A 7/1990 Labbe et al.
4,969,874 A 11/1990 Michel et al.
5,007,458 A 4/1991 Marcus et al.
5,020,325 A 6/1991 Henault
5,062,841 A 11/1991 Siegel
5,147,311 A 9/1992 Pickhard
5,178,609 A 1/1993 Ishikawa
5,205,819 A 4/1993 Ross et al.
5,213,483 A 5/1993 Flaherty et al.
5,222,362 A 6/1993 Maus et al.
5,236,416 A 8/1993 McDaniel et al.
5,261,882 A 11/1993 Sealfon
5,261,884 A 11/1993 Stern et al.
5,277,338 A * 1/1994 Divall ..... B65B 3/32 222/148
5,281,202 A 1/1994 Weber et al.
5,346,476 A 9/1994 Elson
5,364,342 A 11/1994 Beuchat et al.
5,388,615 A 2/1995 Edlund et al.
5,433,710 A 7/1995 VanAntwerp et al.
5,503,628 A 4/1996 Fetters et al.
5,520,661 A 5/1996 Lal et al.
5,533,389 A 7/1996 Kamen et al.
5,582,593 A 12/1996 Hultman
5,618,269 A 4/1997 Jacobsen et al.
5,637,095 A 6/1997 Nason et al.
5,665,070 A 9/1997 McPhee
5,713,875 A 2/1998 Tanner, II
5,747,350 A 5/1998 Sattler
5,748,827 A 5/1998 Holl et al.
5,776,103 A 7/1998 Kriesel et al.
5,779,676 A 7/1998 Kriesel et al.
5,785,688 A 7/1998 Joshi et al.
5,797,881 A 8/1998 Gadot
5,800,397 A 9/1998 Wilson et al.
5,807,075 A 9/1998 Jacobsen et al.
5,839,467 A 11/1998 Saaski et al.
5,891,097 A 4/1999 Saito et al.
5,897,530 A 4/1999 Jackson
5,906,597 A 5/1999 McPhee
5,911,716 A 6/1999 Rake et al.
5,919,167 A 7/1999 Mulhauser et al.
5,957,890 A 9/1999 Mann et al.
5,961,492 A 10/1999 Kriesel et al.
5,971,963 A 10/1999 Choi
6,019,747 A 2/2000 McPhee
6,050,457 A 4/2000 Arnold et al.
6,068,615 A 5/2000 Brown et al.
6,086,615 A 7/2000 Wood et al.
6,159,188 A 12/2000 Laibovitz et al.
6,174,300 B1 1/2001 Kriesel et al.
6,190,359 B1 2/2001 Heruth
6,200,293 B1 3/2001 Kriesel et al.
6,352,522 B1 3/2002 Kim et al.
6,363,609 B1 4/2002 Pickren
6,375,638 B2 4/2002 Nason et al.
6,474,219 B2 11/2002 Klitmose et al.
6,485,461 B1 11/2002 Mason et al.
6,485,462 B1 11/2002 Kriesel
6,488,652 B1 12/2002 Weijand et al.
6,520,936 B1 2/2003 Mann
6,527,744 B1 3/2003 Kriesel et al.
6,537,249 B2 3/2003 Kriesel et al.
6,539,286 B1 3/2003 Jiang
6,569,115 B1 5/2003 Barker et al.
6,595,956 B1 7/2003 Gross et al.
6,656,158 B2 12/2003 Mahoney et al.
6,699,218 B2 3/2004 Flaherty et al.
6,723,072 B2 4/2004 Flaherty et al.
6,749,407 B2 6/2004 Xie et al.
6,851,260 B2 2/2005 Merno
6,883,778 B1 4/2005 Newton et al.
7,018,360 B2 3/2006 Flaherty et al.
7,104,275 B2 9/2006 Dille
7,128,727 B2 10/2006 Flaherty et al.
7,144,384 B2 12/2006 Gorman et al.
7,160,272 B1 1/2007 Eyal et al.
7,771,392 B2 8/2010 De Polo et al.
7,914,499 B2 3/2011 Gonnelli et al.
7,951,114 B2 5/2011 Rush et al.
8,382,703 B1 2/2013 Abdelaal

(56) References Cited

U.S. PATENT DOCUMENTS

| | | | | |
|---|---|---|---|---|
| 8,499,913 | B2 | 8/2013 | Gunter | |
| 8,905,995 | B2 | 12/2014 | Mernoe | |
| 8,920,376 | B2 | 12/2014 | Caffey et al. | |
| 8,939,935 | B2 | 1/2015 | O'Connor et al. | |
| 9,180,244 | B2 | 11/2015 | Anderson et al. | |
| 9,192,716 | B2 | 11/2015 | Jugl et al. | |
| 9,402,950 | B2 | 8/2016 | Dilanni et al. | |
| 9,539,596 | B2 * | 1/2017 | Ikushima | F04B 13/02 |
| 10,441,723 | B2 | 10/2019 | Nazzaro | |
| 10,695,485 | B2 | 6/2020 | Nazzaro | |
| 2001/0016710 | A1 | 8/2001 | Nason et al. | |
| 2001/0056258 | A1 | 12/2001 | Evans | |
| 2002/0029018 | A1 | 3/2002 | Jeffrey | |
| 2002/0032374 | A1 | 3/2002 | Holker et al. | |
| 2002/0037221 | A1 | 3/2002 | Mastrangelo et al. | |
| 2002/0173769 | A1 | 11/2002 | Gray et al. | |
| 2002/0173830 | A1 | 11/2002 | Starkweather et al. | |
| 2003/0040715 | A1 | 2/2003 | D'Antonio et al. | |
| 2003/0097092 | A1 | 5/2003 | Flaherty | |
| 2003/0109827 | A1 | 6/2003 | Lavi et al. | |
| 2003/0163097 | A1 | 8/2003 | Fleury et al. | |
| 2003/0198558 | A1 | 10/2003 | Nason et al. | |
| 2003/0199825 | A1 | 10/2003 | Flaherty | |
| 2004/0010207 | A1 | 1/2004 | Flaherty et al. | |
| 2004/0064088 | A1 | 4/2004 | Gorman et al. | |
| 2004/0068224 | A1 | 4/2004 | Gouvillon et al. | |
| 2004/0069044 | A1 | 4/2004 | Lavi et al. | |
| 2004/0092865 | A1 | 5/2004 | Flaherty et al. | |
| 2004/0094733 | A1 | 5/2004 | Hower et al. | |
| 2004/0153032 | A1 | 8/2004 | Garribotto et al. | |
| 2005/0020980 | A1 | 1/2005 | Inoue et al. | |
| 2005/0165363 | A1 | 7/2005 | Judson et al. | |
| 2005/0203461 | A1 | 9/2005 | Flaherty et al. | |
| 2005/0238507 | A1 | 10/2005 | Dilanni et al. | |
| 2005/0273059 | A1 | 12/2005 | Mernoe et al. | |
| 2005/0277882 | A1 | 12/2005 | Kriesel | |
| 2006/0041229 | A1 | 2/2006 | Garibotto et al. | |
| 2006/0079765 | A1 | 4/2006 | Neer et al. | |
| 2006/0155210 | A1 | 7/2006 | Beckman et al. | |
| 2006/0173439 | A1 | 8/2006 | Thorne et al. | |
| 2006/0178633 | A1 | 8/2006 | Garibotto et al. | |
| 2006/0253085 | A1 | 11/2006 | Geismar et al. | |
| 2006/0282290 | A1 | 12/2006 | Flaherty et al. | |
| 2007/0005018 | A1 | 1/2007 | Tekbuchava | |
| 2007/0073236 | A1 | 3/2007 | Mernoe et al. | |
| 2007/0088271 | A1 * | 4/2007 | Richards | A61M 5/14244 604/151 |
| 2007/0118405 | A1 | 5/2007 | Campbell et al. | |
| 2007/0282269 | A1 | 12/2007 | Carter et al. | |
| 2008/0004515 | A1 | 1/2008 | Jennewine | |
| 2008/0051738 | A1 | 2/2008 | Griffin | |
| 2008/0114304 | A1 | 5/2008 | Nalesso et al. | |
| 2008/0172028 | A1 | 7/2008 | Blomquist | |
| 2008/0243211 | A1 | 10/2008 | Cartwright et al. | |
| 2008/0294040 | A1 * | 11/2008 | Mohiuddin | F04B 13/00 600/432 |
| 2009/0024083 | A1 | 1/2009 | Kriesel et al. | |
| 2009/0062767 | A1 | 3/2009 | Van Antwerp et al. | |
| 2009/0198215 | A1 | 8/2009 | Chong et al. | |
| 2009/0278875 | A1 | 11/2009 | Holm et al. | |
| 2010/0036326 | A1 | 2/2010 | Matusch | |
| 2010/0152658 | A1 | 6/2010 | Hanson et al. | |
| 2010/0241066 | A1 | 9/2010 | Hansen et al. | |
| 2011/0054399 | A1 | 3/2011 | Chong et al. | |
| 2011/0144586 | A1 | 6/2011 | Michaud et al. | |
| 2011/0180480 | A1 | 7/2011 | Kloeffel et al. | |
| 2011/0230833 | A1 | 9/2011 | Landman et al. | |
| 2012/0078161 | A1 | 3/2012 | Masterson et al. | |
| 2013/0006213 | A1 | 1/2013 | Arnitz et al. | |
| 2013/0017099 | A1 | 1/2013 | Genoud et al. | |
| 2013/0064701 | A1 | 3/2013 | Konishi | |
| 2013/0177455 | A1 | 7/2013 | Kamen et al. | |
| 2013/0178803 | A1 | 7/2013 | Raab | |
| 2013/0245545 | A1 | 9/2013 | Arnold et al. | |
| 2013/0267932 | A1 | 10/2013 | Franke et al. | |
| 2014/0018730 | A1 | 1/2014 | Muller-Pathle | |
| 2014/0127048 | A1 | 5/2014 | Dilanni et al. | |
| 2014/0128839 | A1 | 5/2014 | Dilanni et al. | |
| 2014/0142508 | A1 | 5/2014 | Dilanni et al. | |
| 2014/0148784 | A1 | 5/2014 | Anderson et al. | |
| 2014/0171901 | A1 | 6/2014 | Langsdorf et al. | |
| 2015/0041498 | A1 | 2/2015 | Kakiuchi et al. | |
| 2015/0057613 | A1 | 2/2015 | Clemente et al. | |
| 2015/0064036 | A1 * | 3/2015 | Eberhard | A61M 5/16881 417/557 |
| 2015/0137017 | A1 | 5/2015 | Ambrosina et al. | |
| 2015/0202386 | A1 | 7/2015 | Brady et al. | |
| 2015/0290389 | A1 | 10/2015 | Nessel | |
| 2015/0297825 | A1 | 10/2015 | Focht et al. | |
| 2016/0008549 | A1 | 1/2016 | Plumptre et al. | |
| 2016/0025544 | A1 | 1/2016 | Kamen et al. | |
| 2016/0055842 | A1 | 2/2016 | DeFranks et al. | |
| 2016/0082242 | A1 | 3/2016 | Burton et al. | |
| 2016/0129190 | A1 | 5/2016 | Haitsuka | |
| 2016/0193423 | A1 | 7/2016 | Bilton | |
| 2017/0021096 | A1 | 1/2017 | Cole et al. | |
| 2017/0021137 | A1 | 1/2017 | Cole | |
| 2017/0100541 | A1 | 4/2017 | Constantineau et al. | |
| 2017/0239415 | A1 | 8/2017 | Hwang et al. | |
| 2017/0216516 | A1 | 12/2017 | Fraser et al. | |
| 2018/0021521 | A1 | 1/2018 | Sanchez | |
| 2018/0185579 | A1 | 7/2018 | Joseph et al. | |
| 2018/0313346 | A1 | 11/2018 | Oakes et al. | |
| 2019/0192782 | A1 | 6/2019 | Pedersen et al. | |
| 2019/0365993 | A1 | 12/2019 | Staub et al. | |
| 2020/0009315 | A1 | 1/2020 | Brouet et al. | |

FOREIGN PATENT DOCUMENTS

| | | | |
|---|---|---|---|
| DE | 4200595 | A1 | 7/1993 |
| DE | 19723648 | C1 | 8/1998 |
| EP | 0454331 | A1 | 10/1991 |
| EP | 0789146 | A1 | 8/1997 |
| EP | 0867196 | A2 | 9/1998 |
| EP | 1065378 | A2 | 1/2001 |
| EP | 1177802 | A1 | 2/2002 |
| EP | 1403519 | A1 | 3/2004 |
| EP | 2397181 | A1 | 12/2011 |
| EP | 2468338 | A1 | 6/2012 |
| EP | 2703024 | A1 | 3/2014 |
| EP | 2830499 | A1 | 2/2015 |
| FR | 2096275 | A5 | 2/1972 |
| FR | 2455269 | A1 | 11/1980 |
| FR | 2507637 | A1 | 12/1982 |
| FR | 2731475 | A1 | 9/1996 |
| GB | 357139 | A | 9/1931 |
| GB | 810488 | A | 3/1959 |
| GB | 875034 | A | 8/1961 |
| GB | 1204836 | A | 9/1970 |
| GB | 2008806 | A | 6/1979 |
| GB | 2077367 | A | 12/1981 |
| GB | 2456681 | A | 7/2009 |
| GB | 2549750 | A | 11/2017 |
| IL | 46017 | A | 11/1977 |
| JP | 06063133 | A | 3/1994 |
| JP | H06296690 | A | 10/1994 |
| JP | H08238324 | A | 9/1996 |
| JP | 2004247271 | A | 9/2004 |
| JP | 2004274719 | A | 9/2004 |
| JP | 2005188355 | A | 7/2005 |
| JP | 2006159228 | A | 6/2006 |
| JP | 6098988 | B2 | 9/2006 |
| JP | 2006249130 | A | 9/2006 |
| NL | 1019126 | C1 | 4/2003 |
| WO | 8101658 | A1 | 6/1981 |
| WO | 8606796 | A1 | 11/1986 |
| WO | 9320864 | A1 | 10/1993 |
| WO | 9415660 | A1 | 7/1994 |
| WO | 9855073 | A1 | 12/1998 |
| WO | 9856293 | A1 | 12/1998 |
| WO | 9910040 | A1 | 3/1999 |
| WO | 9910049 | A1 | 3/1999 |
| WO | 9962576 | A1 | 12/1999 |
| WO | 0029047 | A1 | 5/2000 |

(56) References Cited

FOREIGN PATENT DOCUMENTS

| | | | |
|---|---|---|---|
| WO | 0178812 | A1 | 10/2001 |
| WO | 0220073 | A2 | 3/2002 |
| WO | 2002026282 | A2 | 4/2002 |
| WO | 02068823 | A1 | 9/2002 |
| WO | 2002076535 | A1 | 10/2002 |
| WO | 2003097133 | A1 | 11/2003 |
| WO | 2004032994 | A2 | 4/2004 |
| WO | 2004056412 | A2 | 7/2004 |
| WO | 2004110526 | A1 | 12/2004 |
| WO | 2007066152 | A2 | 6/2007 |
| WO | 2008133702 | A1 | 11/2008 |
| WO | 2009039203 | A2 | 3/2009 |
| WO | 2009141005 | A1 | 11/2009 |
| WO | 2010139793 | A1 | 12/2010 |
| WO | 2011010198 | A2 | 1/2011 |
| WO | 2011069935 | A2 | 6/2011 |
| WO | 2011075042 | A1 | 6/2011 |
| WO | 2011133823 | A1 | 10/2011 |
| WO | 2012073032 | A1 | 6/2012 |
| WO | 2013050535 | A2 | 4/2013 |
| WO | 2013137893 | A1 | 9/2013 |
| WO | 2013149186 | A1 | 10/2013 |
| WO | 2014149357 | A1 | 9/2014 |
| WO | 2015032772 | A1 | 3/2015 |
| WO | 2015081337 | A2 | 6/2015 |
| WO | 2015117854 | A1 | 8/2015 |
| WO | 2015167201 | A1 | 11/2015 |
| WO | 2015177082 | A1 | 11/2015 |
| WO | 2017148855 | A1 | 9/2017 |
| WO | 2017187177 | A1 | 11/2017 |

OTHER PUBLICATIONS

Lind, et al., "Linear Motion Miniature Actuators." Paper presented at the 2nd Tampere International Conference on Machine Automation, Tampere, Finland (Sep. 1998), 2 pages.

Author unknown, "The Animas R-1000 Insulin Pump—Animas Corporation intends to exit the insulin pump business and discontinue the manufacturing and sale of Animas® Vibe® and One Touch Ping® insulin pumps." [online], Dec. 1999 [retrieved on Jan. 8, 2019]. Retrieved from the Internet URL: http://www.animaspatientsupport.com/, 2 pages.

Author unknown, CeramTec "Discover the Electro Ceramic Products CeramTec acquired from Morgan Advanced Materials" [online], Mar. 1, 2001 [retrieved on Jan. 8, 2019. Retrieved from the Internet URL: http://www.morgantechnicalceramics.com/, 2 pages.

Vaughan, M.E., "The Design. Fabrication, and Modeling of a Piezoelectric Linear Motor." Master's thesis, Virginia Polytechnic Institute and State University, VA. (2001), 93 pages.

Galante, et al., "Design, Modeling, and Performance of a High Force Piezoelectric Inchworm Motor." Journal of Intelligent Material Systems and Structures, vol. 10, 962-972 (1999), 11 pages.

International Search Report and Written Opinion for International Application No. PCT/US2018/014351, dated Jun. 4, 2018, 9 pages.

International Search Report and Written Opinion for International Application No. PCT/US2017/055054, dated Jan. 25, 2018, 13 pages.

International Search Report and Written Opinion for International Application No. PCT/US2018/045155, dated Oct. 15, 2018, 15 pages.

International Search Report and Written Opinion for International Application No. PCT/US2017/034811, dated Oct. 18, 2017, 17 pages.

International Search Report and Written Opinion for International Application No. PCT/US2017/046508, dated Jan. 17, 2018, 14 pages.

International Search Report and Written Opinion for International Application No. PCT/US2017/034814, dated Oct. 11, 2017, 18 pages.

International Search Report and Written Opinion for International Application No. PCT/US2017/046777, dated Dec. 13, 2017, 14 pages.

International Search Report and Written Opinion for International Application No. PCT/US2017/046737, dated Dec. 14, 2017, 11 pages.

International Preliminary Report on Patentability for the International Patent Application No. PCT/US18/14351, dated Aug. 1, 2019, 6 pages.

International Preliminary Report on Patentability for the International Patent Application No. PCT/US2017/046777, dated Feb. 19, 2019, 8 pages.

International Preliminary Report on Patentability for the International Patent Application No. PCT/US2017/046737, dated Feb. 19, 2019, 8 pages.

International Preliminary Report on Patentability for the International Patent Application No. PCT/US2017/055054, dated Apr. 9, 2019, 8 pages.

EPO Search Report dated Nov. 11, 2015, received in corresponding Application No. 13768938.6, 7 pgs.

PCT International Search Report and Written Opinion dated Aug. 6, 2013, received in corresponding PCT Application No. PCT/US13/34674, pp. 1-19.

International Search Report and Written Opinion for International application No. PCT/GB2007/004073, dated Jan. 31, 2008.

International Search Report and Written Opinion for the International Patent Application No. PCT/US2019/063615, dated May 3, 2020, 16 pages.

International Preliminary Report on Patentability for the International Patent Application No. PCT/US2018/045155, dated Feb. 13, 2020, 10 pages.

International Search Report and Written Opinion for the International Patent Application No. PCT/US2019/035756, dated Jul. 31, 2019, 11 pages.

International Search Report and Written Opinion for Application No. PCT/US2019/059854, dated Aug. 26, 2020, 15 pages.

European Search Repod and Written Opinion for the European Patent Application No. EP20174878, dated Sep. 29, 2020, 52 pages.

Schott web-page image from Jul. 9, 2016, https://www.us.schott.com/pharmaceutical_packaging/english/products/cartridges.html.

* cited by examiner

MICRO PISTON PUMP

CROSS-REFERENCE TO RELATED APPLICATIONS

This application claims the benefit of U.S. Provisional Application No. 62/540,954, filed Aug. 3, 2017, and U.S. Provisional Application No. 62/699,022, filed Jul. 17, 2018, each of which is incorporated herein by reference in its entirety.

TECHNICAL FIELD

Embodiments generally relate to medication delivery. More particularly, embodiments relate to micro piston pump systems for delivering a liquid drug to a user.

BACKGROUND

Many conventional drug delivery devices include a rigid reservoir for storing a liquid drug. A drive mechanism is operated to expel the stored liquid drug from the reservoir for delivery to a user. Many conventional drive mechanisms use a plunger to expel the liquid drug from a rigid reservoir. Since the plunger must have a length approximately equal to the length of the reservoir, the total length of the drive mechanism and reservoir can be about twice the length of the reservoir. As a result, many conventional drug delivery devices must be made larger to accommodate the reservoir and plunger, often leading to a bulky device that is uncomfortable for the user to wear.

To reduce the size of the drive mechanism, other pumping systems can be used. For disposable drug delivery devices, many low-cost alternative pumping systems fail to provide small doses of a drug to a user with a high degree of accuracy. Some drug delivery systems may use a micro diaphragm pump to reduce size; however, many of these pump systems are expensive to manufacture and require expensive check valves to ensure safe operation.

Accordingly, there is a need for a system for expelling a liquid drug from a reservoir that can accurately dispense low doses of a drug, can be produced reliably at low cost, and can minimize any increase to the size of a drug delivery device, allowing the overall size and form factor of the drug delivery device to remain compact and user-friendly.

DETAILED DESCRIPTION

This disclosure presents various systems, components, and methods related to drug delivery devices. Each of the systems, components, and methods disclosed herein provides one or more advantages over conventional systems, components, and methods.

Various embodiments include a low-force, non-displacement, micro/miniature valve and/or pump assembly. Various embodiments provide a two position, four-way ported valve and/or pump assembly connecting two pump chambers alternatively to an inlet and an outlet of a valve body. Fluid can be drawn in and pushed out of piston pump chambers based on each actuation of the pistons. Other embodiments are disclosed and described.

Figure 1:
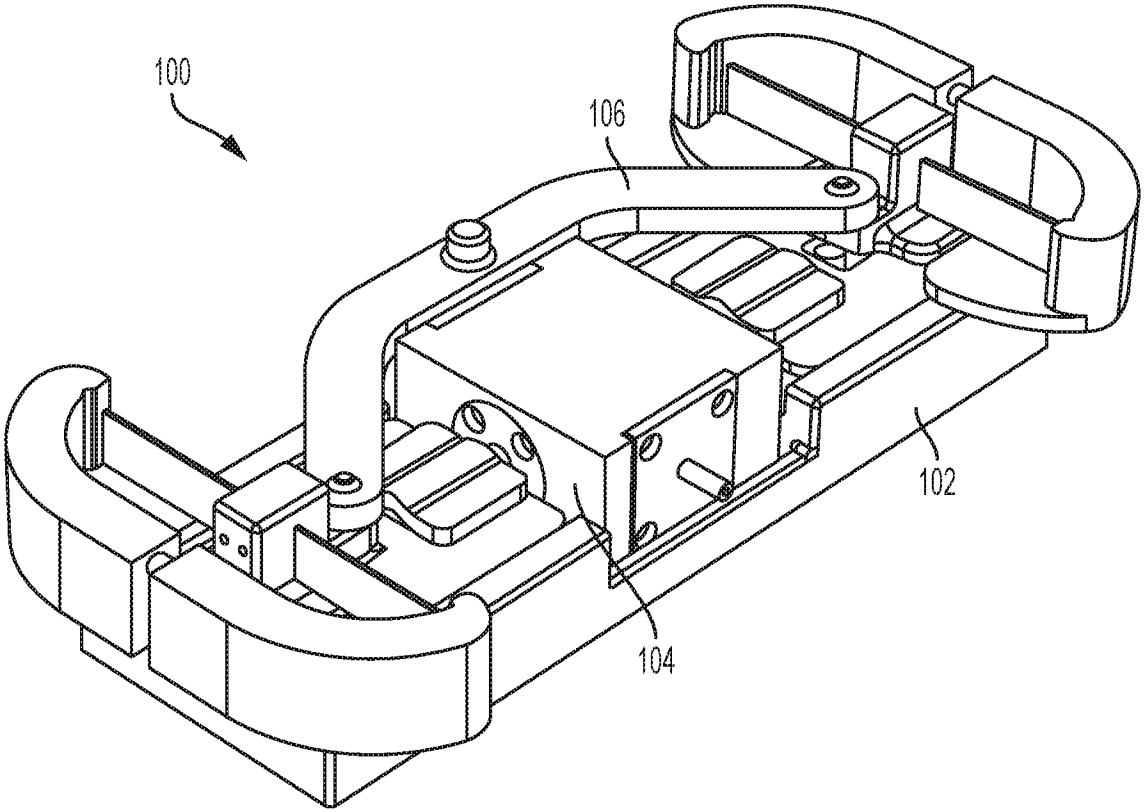
FIG. 1 illustrates an exemplary pump assembly.

FIG. 1 illustrates an exemplary pump assembly or system 100. The pump assembly 100 can be a micro pump assembly as described herein. FIG. 1 shows an isometric view of the pump assembly 100. As shown in FIG. 1, the pump assembly 100 can include a pump base 102, a fluid path assembly (or fluid path components assembly) 104, and an actuator linkage component 106.

The pump base 102 can support the fluid path assembly 104 and the actuator linkage 106. The pump base 102 can be a lead frame injection molded plastic component. The pump base 102 can include electrical contacts as described herein. The fluid path assembly 104 can include multiple components described further herein. The fluid path assembly 104 can include a micro piston pump block (e.g., see FIG. 2, piston pump block 206). The piston pump block can rest or be seated on the pump base 102. In various embodiments, the piston pump block can be formed as an integral component of the pump base 102. In other embodiments, the piston pump block can be formed as a separate component from the pump base 102. The actuator linkage 106 can be formed of stamped metal or can be an injection molded assembly. The actuator linkage 106 can be formed from one or more components. In various embodiments, the actuator linkage 105 can include multiple hinged or otherwise connected components. The actuator linkage 106 can couple the sides of the fluid path assembly 104 to facilitate operation of the pump assembly 100 (e.g., to coordinate actuation of the pistons of the pump assembly 100) as described further herein.

Figure 2:
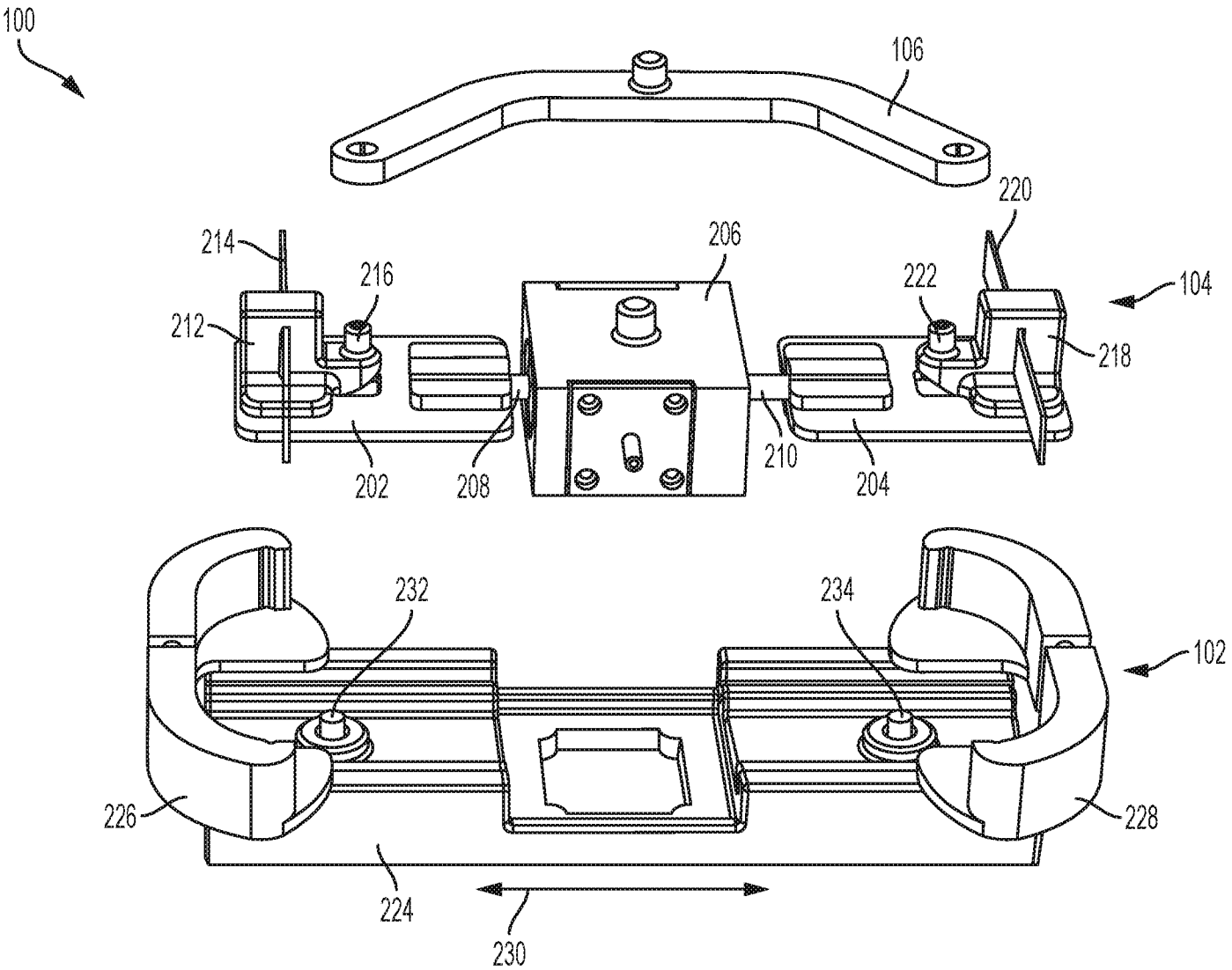
FIG. 2 illustrates an exploded view of the pump assembly.

FIG. 2 illustrates an exploded view of the pump assembly 100. As shown in FIG. 2, the fluid path assembly 104 can include a first piston plate 202, a second piston plate 204, a piston pump block (or valve body) 206, a first piston 208, and a second piston 210. The first piston 208 can be positioned between the piston pump block 206 and the first piston plate 202 and coupled thereto. The second piston 210 can be positioned between the piston pump block 206 and the second piston plate 204 and coupled thereto. The piston pump block 206 can be formed from micro injection molded plastic. The pistons 208 and 210 can each be formed from precision drawn wire or ground stock.

The first piston plate 202 can include a first component or block 212 that supports a bi-stable element 214 (e.g., a bi-stable spring). The first piston plate 202 can further include a second component 216 that can provide coupling to a first end of the actuator linkage 106. The first component 212 and the second component 216 can each be raised portions or extensions of the first piston plate 202. Similarly, the second piston plate 204 can include a third component or block 218 that supports a bi-stable element 220 (e.g., a bi-stable spring). The second piston plate 204 can further include a fourth component 222 that can provide coupling to a second end of the actuator linkage 106. The third component 218 and the fourth component 222 can each be raised portions or extensions of the second piston plate 204. In various embodiments, each piston plate 202 and 204 can be a stamped metal plate having the integral bi-stable springs 214 and 220 (e.g., extending outward and/or away from the extension components 212 and 218). In various embodiments, each piston plate 202 and 204 can be an over-molded component enclosing a bi-stable element 214 and 220, respectively.

In various embodiments, the piston plate 202, the first component 212, the second component 216, and the bi-stable element 214 can be integrally formed (e.g., as part of a single, unitary piece of component). In various embodiments, these constituent components can be formed together through injection molding. Under such a scenario, these constituent components can be considered to be a first piston assembly or portion thereof (e.g., including the piston 208)

Similarly, in various embodiments, the piston plate 204, the first component 218, the second component 222, and the bi-stable element 220 can be integrally formed (e.g., as part of a single, unitary piece of component). In various embodiments, these constituent components can be formed together through injection molding. Under such a scenario, these constituent components can be considered to be a second piston assembly or portion thereof (e.g., including the piston 210).

The pump base 102 can include a base component 224 on which the piston pump block 206 and the pistons plates 202 and 204 can rest and/or be positioned on. The pump base 102 can further include a first arm or extension 226 and a second arm or extension 228. The first and second arm extensions 226 and 228 can be positioned at opposite ends of the pump base 102. The first extension 226 can be coupled to and/or can support the bi-stable spring 214. The second extension 228 can be coupled to and/or can support the bi-stable spring 220. In various embodiments, the first and second arm extensions 226 and 228 can be positioned closer to a center of the pump base 102.

The piston pump block 206 can remain in a stationary position during operation while the piston plates 202 and 204 can move back and forth in the directions shown by indicator 230 along the base 224. The pump base 102 can include a first stop 232 and a second stop 234. The first and second stops 232 and 234 can engage the pistons 208 and 210, respectively, as they move in the back and forth directions 230. The stops 232 and 234 can limit a maximum displacement of the pistons 208 and 210, respectively. Further, the stops 232 and 234 can be conductive and can operate as electrical contacts, such that a position of the pistons 208 and 210 can be detected based on contact with the stop 232 or 234.

The actuator linkage 106 can be coupled to the extension 216 and the extension 222. The actuator linkage 106 can ensure coordinated operation and/or movement of the pistons 208 and 210 by ensuring the piston plates 202 and 204 move together (e.g., in unison in the same direction at the same time). The actuator linkage 106 can also be coupled to the piston pump block 206 (e.g., along any portion of the top of the piston pump block 206). In various embodiments, the pistons 208 and 210 can be moved separately and/or independently to enable sequential actuation or movement of the pistons 208 and 210.

Figure 3:
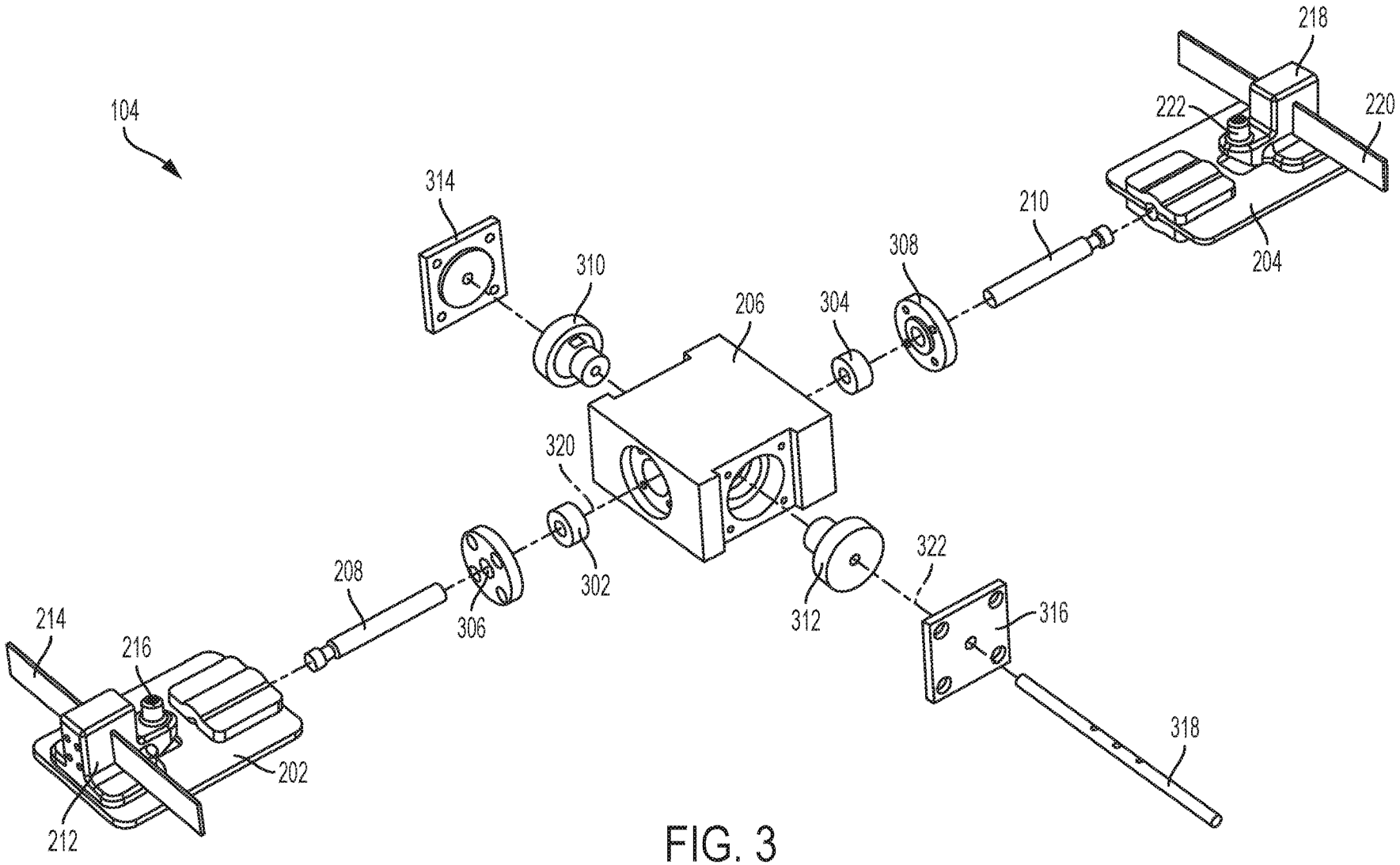
FIG. 3 illustrates an exploded view of the fluid path assembly depicted in FIGS. 1 and 2.

FIG. 3 illustrates an exploded view of the fluid path assembly 104. In conjunction to the components described in relation to FIGS. 1 and 2, the fluid path assembly 104 can further include a first piston seal 302 and a second piston seal 304. The piston seals 302 and 304 can be positioned within open areas of the piston pump block 206. The piston seals 302 and 304 can be formed by injection molded liquid silicone rubber. The fluid path assembly 104 can further include a first piston seal retainer 306 and a second piston seal retainer 308. The piston seal retainers 306 and 308 can be formed of injection molded plastic, can fit into open areas of the piston pump block 206, and can press or fit the piston seals 302 and 304 into proper position. In various embodiments, the piston seal retainers 306 and 308 can be formed by deforming portions of the piston pump block 206—for example, by crushing, heat staking, or otherwise deforming material forming the block 206 to create a retaining feature or component (and/or to provide the retaining functions of the retainers 306 and 308).

As further shown in FIG. 3, the fluid path assembly 104 can further include a first needle septum 310 and a second needle septum 312. The septa 310 and 312 can be cross ported and can be positioned or fitted into open areas of the piston pump block 206. A first needle valve seal retainer 314 and a second needle valve seal retainer 316 can be pressed or fitted into open areas of the piston pump block to maintain proper positioning or fit of the septa 310 and 312, respectively. The fluid path assembly 104 can also include a side slit cannula (or side port needle or tube component) 318. The cannula 318 can be positioned through the retainers 314 and 316, the septa 310 and 312, and the piston pump block 206. The pistons 208 and 210 can be positioned through the seal retainers 306 and 308 and the piston seals 302 and 304, respectively, as well as partially positioned within the piston pump block 206.

FIG. 3 further illustrates a first central axis 320 and a second central axis 322. The first central axis 320 and the second central axis 322 can be perpendicular to one another. The components shown in FIG. 3 can be aligned relative to the first central axis 320 and/or the second central axis 322 as shown. In particular, the tube component 318 can be aligned with respect to the second central axis 322 as shown. The tube component 318 can move in directions parallel to the second central axis 322 as described herein. The first and second pistons 208 and 210 can be aligned with respect to the first central axis 320 as shown. The first and second pistons 208 and 210 can move in directions parallel to the first central axis 320 as described herein.

Figure 4:
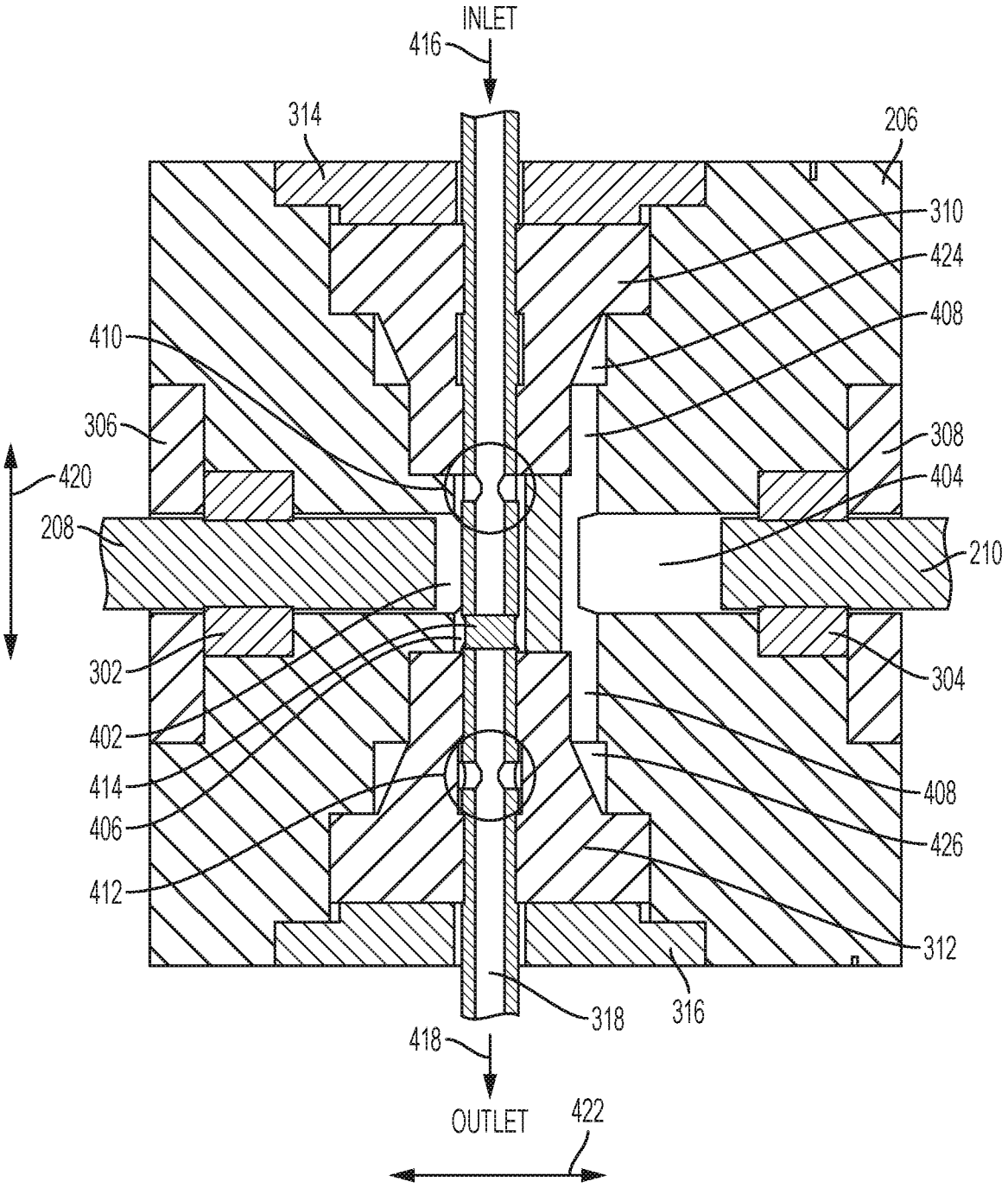
FIG. 4 illustrates an overhead cross-sectional view of a portion of the fluid path assembly depicted in FIG. 3.

FIG. 4 illustrates an overhead cross-sectional view of a portion of the fluid path assembly 104. Specifically, FIG. 4 shows the components operating within and/or directly coupled to the piston pump block 206 (e.g., all portions of the fluid path assembly other than the plates 202 and 204). As shown in FIG. 4, the tube component 318 can be positioned within an opening or slot (or channel) of the pump block 206 and openings or slots (or channels) of the septa 310 and 312. The tube component 318 can include a first opening or side port (or side slit) 410, a second opening or side port (or side slit) 412, and a center plug 414. The tube component 318 can be a rigid tubing placed into the valve body 206. The piston pump block 206 can also be referred to as a pump block.

The center plug 414 can be installed into the tube component 318 as a separate piece or component from the tube component 318 or can be formed through a spot-weld crimp, swage, or crushing process. A first portion of the tube component 318 (including a first end) can be or can form an inlet component 416 of the tube component 318. A second portion of the tube component 318 (including a second end) can be or can form an outlet component 418 of the tube component 318.

The center plug 414 can help prevent fluid (e.g., a liquid drug) from flowing directly between the inlet component 416 and the outlet component 418 (e.g., can separate the inlet and outlet components 416 and 418). In various embodiments, the inlet component 416 can be coupled to a reservoir storing a liquid drug or other therapeutic agent and the outlet component 418 can be coupled to a fluid path component (e.g., a cannula) coupled to a patient.

The septa 310 and 312 can be formed from liquid silicone rubber or other compatible elastomeric material. The septa 310 and 312 can each be formed (e.g., molded) as a single component or piece or as multiple components or pieces. The septa 310 and 312 can each be pierced by the tube component 318. The tube component 318 can be moved along directions shown by indicator 420 (e.g., up and down relative to the orientation of the components depicted in FIG. 4). The septa 310 and 312 can be aligned as shown (see FIG. 3).

As further shown in FIG. 4, the piston 208 can be positioned within a first piston pump chamber 402. The piston 210 can be positioned within a second piston pump chamber 404. The first and second piston pump chambers 402 and 404 can be open areas within the valve body 206. The first and second pistons 208 and 210 can be moved (e.g., linearly) within the first piston pump chamber 402 and the second piston pump chamber 404, respectively, along directions shown by indicator 422. In various embodiments, the directions 402 and 422 can be perpendicular to one another.

The arrangement of the components of the fluid path assembly 104 shown in FIG. 4 can form a low force, non-displacement, micro/miniature valve or valve system. The valve system can provide a cross-flow valve that provide a two position, four-way ported valve that can alternatively connect the pump chambers 402 and 404 to the inlet component 416 and the outlet component 418 of the pump block 206. In various embodiments, other means or components for positioning the seals 302 and 304 and/or the sept 310 and 312 can be used such that retainers 306 and 308 and/or retainers 314 and 316 are not used or included.

In various embodiments, the septa 310 and 312 can form radial seals with the pump block 206. The septa 310 and 312 can each include two radial sealing faces to the pump block 206 separated with an opening or through-hole (e.g., a void) where no seal to the tube component 318 is provided. The voids can create openings that can provide fluid channels to the tube component 318. In various embodiments, the septa 310 and 312 can also form faces seals with the pump block 206.

In various embodiments, the pump block 206 can include a first fluid channel 406 and a second fluid channel 408. The fluid channel 406 and the piston chamber 402 can be coupled to the inlet component 416 (e.g., by way of the port 410) or coupled to the outlet component 418 (e.g., by way of the port 412) based on the position of the tube component 318. Similarly, the fluid channel 408 and the piston chamber 404 can be coupled to the inlet component 416 (e.g., by way of the port 410 and the cross-porting feature of septa 310; see FIGS. 14A and 14B) or the outlet component 418 (e.g., by way of the port 412 and the cross-porting feature of septa 312; see FIGS. 14A and 14B) based on the position of the tube component 318.

As shown in FIG. 4, the first channel 406 is shorter than the second channel 408 and can extend to front portions of the septa 310 and 312 while the second channel 408 can extend to middle sections of the septa 310 and 312, but neither are so limited. As described further herein, the valve system depicted in FIG. 4 can operate by moving the tube component 318 to certain positions along the septa 310 and 312 and subsequently moving the pistons 208 and 210, thereby coupling the pistons 208 and 210 to the inlet component 416 and outlet components 418 in a manner that causes fluid to be pumped into or out of the pump block 206 during each stroke of the pistons 206 and 208.

As shown in FIG. 4, a first annular fluid chamber 424 and a second annular fluid chamber 426 can be coupled to the channel 408. The annular chambers 424 and 426 can be positioned around a portion (e.g., middle portion) of the septa 310 and 312 as shown. Depending on the position of the tube component 318, the annular chamber 424 can allow fluid to flow through the septa 310 and into the chamber 404 or allow fluid to flow from the chamber 404 through the septa 312.

FIGS. 5-8 illustrate operation of the components of the fluid path assembly 104 depicted in FIG. 4. Specifically, FIGS. 5-8 illustrate a sequence of operations for drawing in fluid to the piston chambers 402 and 404 from the inlet component 416 and pumping the fluid out of the piston chambers 402 and 404 through the outlet component 418. As mentioned, the inlet component 416 can be coupled to a reservoir storing a liquid drug and the outlet component 418 can be coupled to a fluid path component that is coupled to a user (e.g., a cannula).

Figure 5:
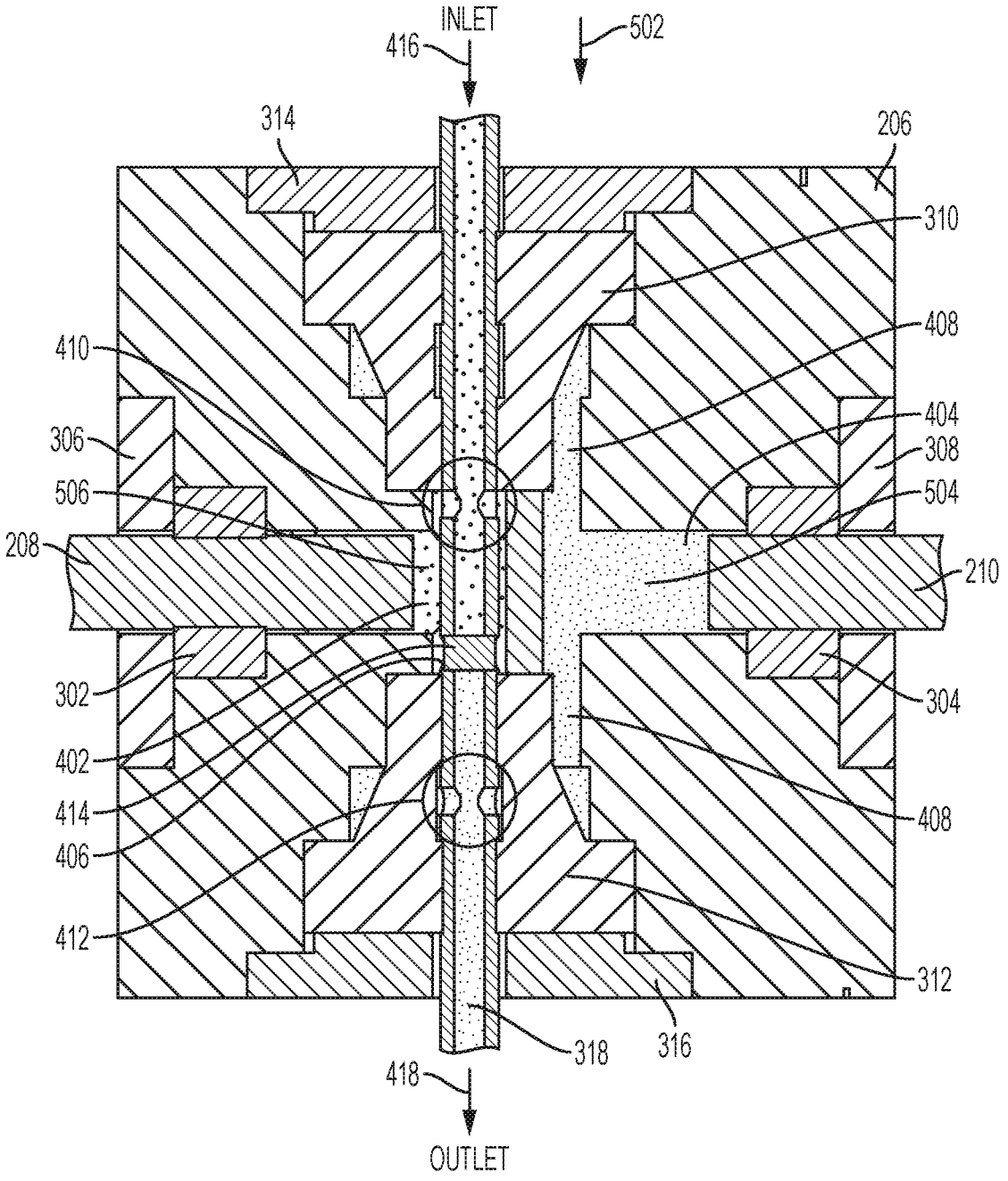
FIG. 5 illustrates a first stage of operation of the of the portion of the fluid path assembly depicted in FIG. 4.

FIG. 5 illustrates a first stage or initial stage of operation. In the first or initial operational state, the tube component 318 can be actuated to move in a direction 502 (e.g., toward the septum 312) to set the side ports 410 and 412 into appropriate positions for valving (e.g., a stroke of the pistons 208 and 210). Specifically, the tube component 318 can be moved to position the side port 410 (e.g., the side port connected to the inlet component 416) to be coupled to the piston chamber 402. Further, the side port 412 (e.g., the side port coupled to the outlet component 418) can be positioned to be coupled the piston chamber 404.

A first fluid region is shown by indicator 504 and a separate second fluid region is shown by indicator 506. In the first or initial operational state, a first portion of the fluid from the reservoir coupled to the inlet component 416 can be positioned within the pump chamber 404 and/or within the first fluid region 504. In various embodiments, the pump chamber 402 can be empty or devoid of any of the fluid and/or can include a second portion of the fluid (e.g., within the second fluid region 506).

Figure 6:
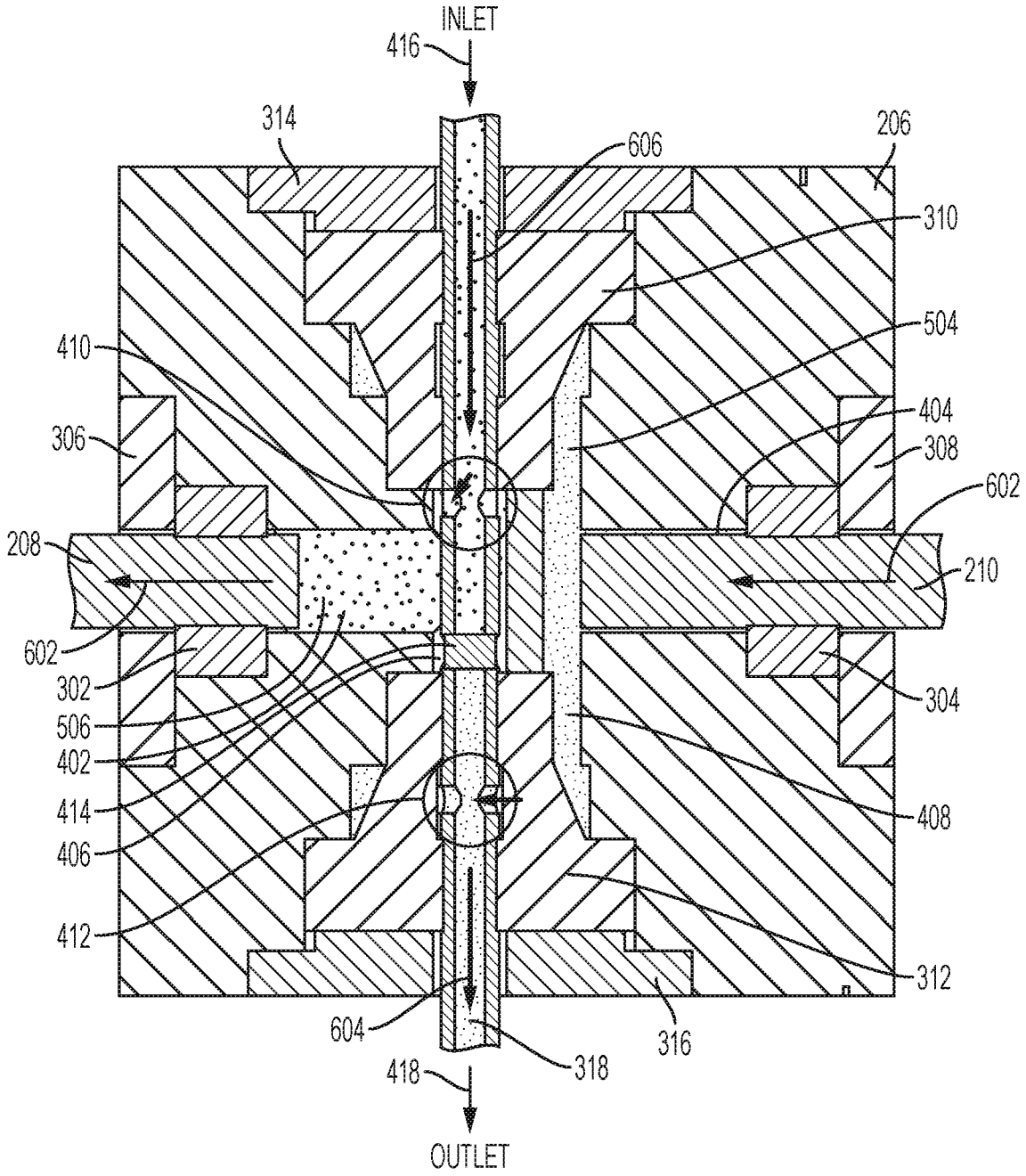
FIG. 6 illustrates a second stage of operation of the of the portion of the fluid path assembly depicted in FIG. 4.

FIG. 6 illustrates a second stage of operation (e.g., subsequent to the stage of operation depicted in FIG. 5). As shown in FIG. 6, the pistons 208 and 210 can both be actuated (e.g., in unison) to move in a direction 602. As a result of the movement of the piston 210 in the direction 602, fluid can be pushed out of the pump chamber 404, through the septum 312 (e.g., through the side port of the septum 312), through the side port 412, and then out through the outlet component 418 (e.g., for delivery to a patient)—as indicated by flow arrows 604. Further, fluid from the reservoir coupled to the inlet component 416 can be drawn in from the inlet component 416 to the pump chamber 402 by way of the side port 410—as indicated by flow arrows 606. Again, the indicator 504 shows the first fluid region associated with the pump chamber 404 and the indicator 506 shows the second fluid region associated with the pump chamber 402.

Figure 7:
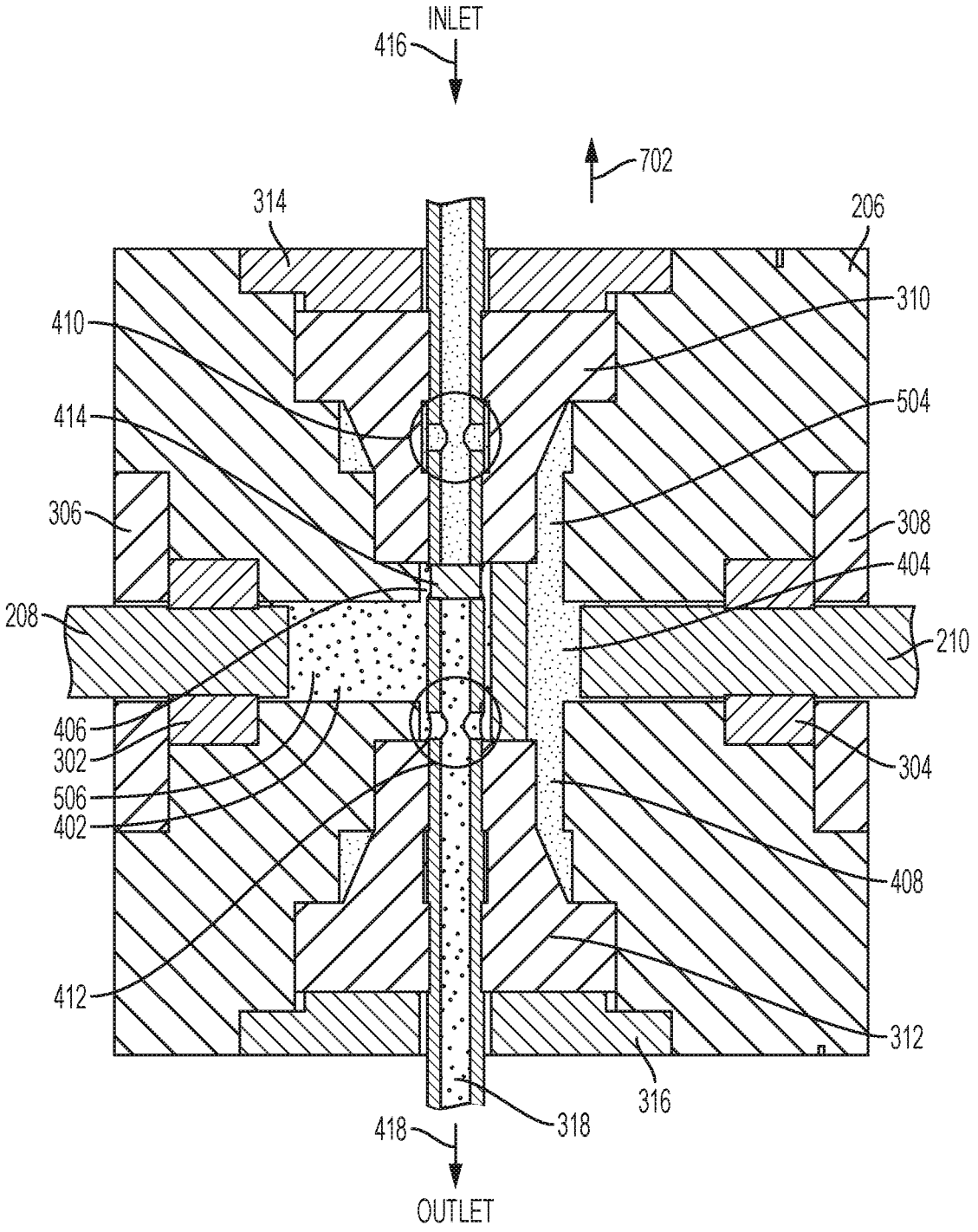
FIG. 7 illustrates a third stage of operation of the of the portion of the fluid path assembly depicted in FIG. 4.

FIG. 7 illustrates a third stage of operation (subsequent to the stage of operation depicted in FIG. 6). As shown in FIG. 7, the tube component 318 is actuated to move in a direction 702 (e.g., toward the septum 310). Specifically, the tube component 318 is moved to couple the side port 410 to the piston chamber 404. Further, the side port 412 is coupled to the piston chamber 402. The indicator 504 again shows the first fluid region associated with the pump chamber 404 and the indicator 506 shows the second fluid region associated with the pump chamber 402.

Figure 8:
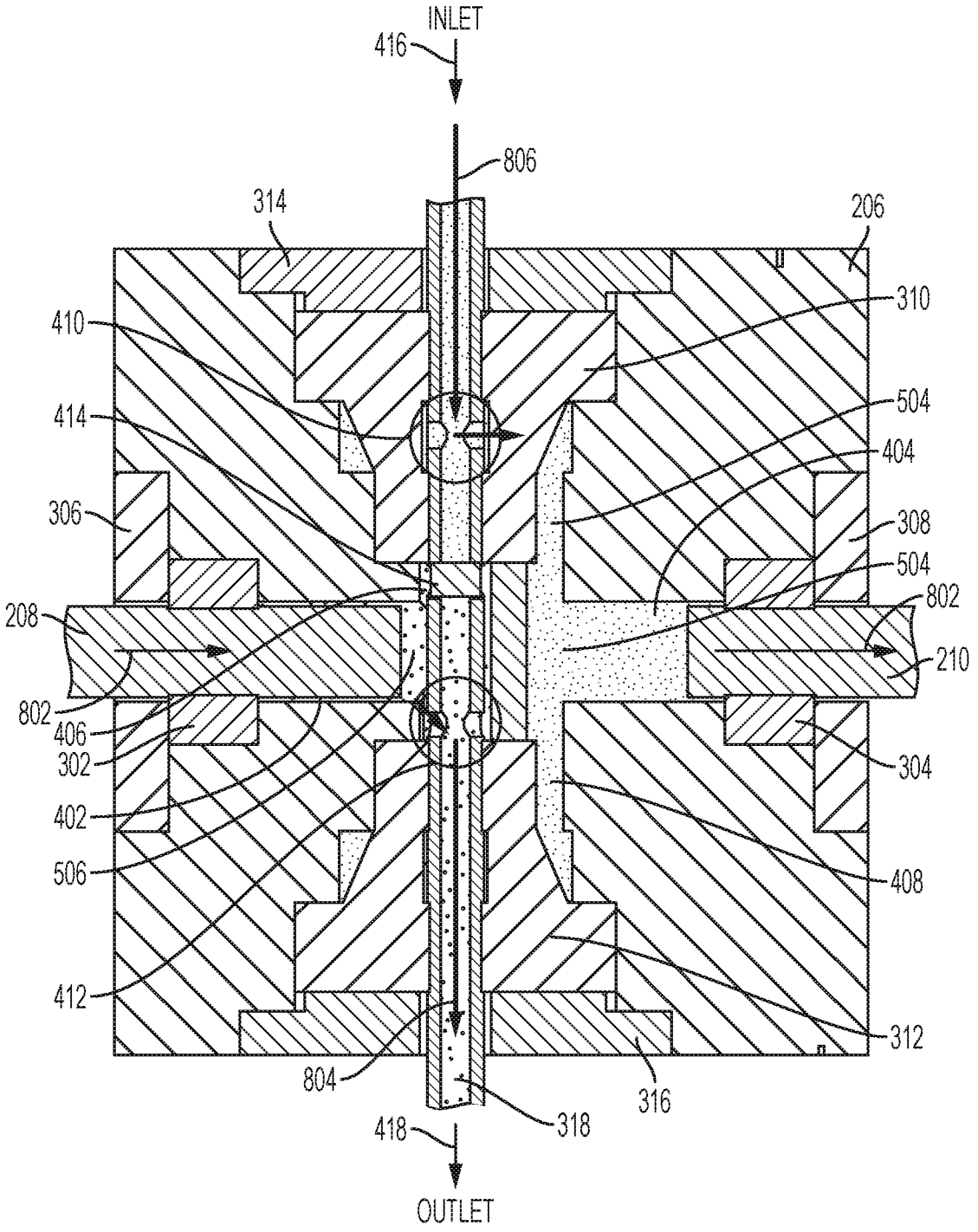
FIG. 8 illustrates a fourth stage of operation of the of the portion of the fluid path assembly depicted in FIG. 4.

FIG. 8 illustrates a fourth stage of operation (subsequent to the stage of operation depicted in FIG. 7). As shown in FIG. 8, the pistons 208 and 210 are both actuated (e.g., in unison) to move in a direction 802. As a result of the movement of the piston 208 in the direction 802, fluid can be pushed out of the pump chamber 402, through the side port 412, and then out through the outlet component 418 (e.g., for delivery to a patient)—as indicated by flow arrows 804. Further, fluid from the reservoir coupled to the inlet component 416 can be drawn in from the inlet component 416 to the pump chamber 404—as indicated by flow arrows 806. The indicator 504 again shows the first fluid region associated with the pump chamber 404 and the indicator 506 shows the second fluid region associated with the pump chamber 402.

As shown by FIGS. 5-8, the valve system depicted in FIG. 4 can be operated to draw in a portion of a liquid drug and to expel a portion of the liquid on each piston stroke (e.g., each movement of the pistons 208 and 210) by adjusting a positing of the tube component 318 between each stroke. During each stroke, fluid can be either drawn into the pump chamber 402 and pushed out of the pump chamber 404 or can be pushed out of the pump chamber 402 and drawn into the pump chamber 404. The sequence of operations (e.g., operational states) depicted in FIGS. 5-8 can be repeated to implement a subsequent cycle of drawing in the fluid through the inlet component 416 from the reservoir and pushing the fluid out through the outlet component 418 for delivery to a patient. The sequence of operations can be repeated any number of times to deliver any size of dose of the fluid to the user.

FIGS. 9-12 illustrate operation of the overall pump assembly 100 for drawing in and pumping out a liquid drug for delivery to a patient. The sequence of operations and operational states shown in FIGS. 9-12 can correspond to those shown in FIGS. 5-8 for the depicted components of the fluid path assembly 104. FIGS. 9-12 in particular show the interaction of the actuator linkage 106 with the fluid path assembly 104 and the base 102 during actuation of the tube component 318 and the pistons 208 and 210. FIGS. 9-12 show overhead views of the pump assembly.

Figure 9:
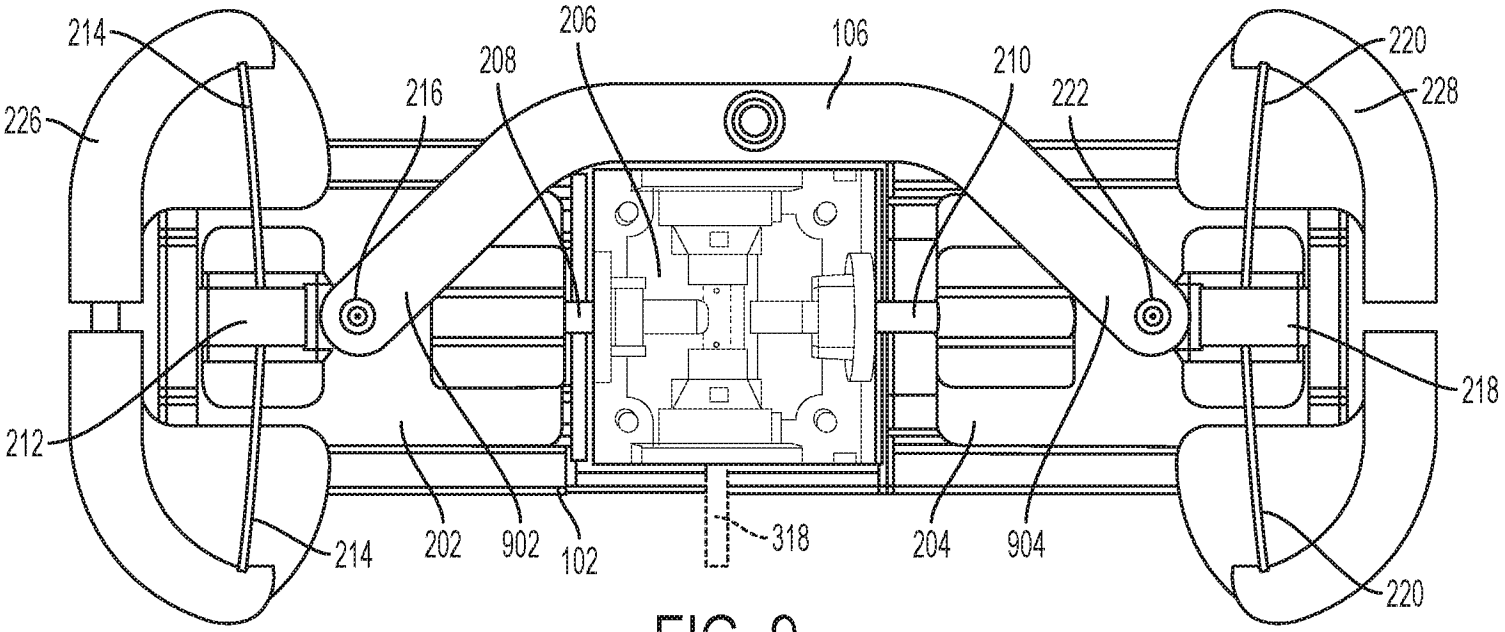
FIG. 9 illustrates a first stage of operation of the pump assembly depicted in FIGS. 1 and 2.

FIG. 9 illustrates a first stage or initial stage of operation of the pump assembly 100. This first operational state can correspond to the operational state of the components depicted in FIG. 5. In this first or initial operational state, the tube component 318 (and corresponding, the side ports 410 and 412) is positioned in a manner corresponding to the positioning of the tube component 318 as shown in FIG. 5 (e.g., shifted toward septum 316). In various embodiments, a conductive travel stop component (e.g., similar to stop components 232 and 234; not shown in FIG. 9 for simplicity) can be confirm proper valve actuation and can be coupled to the tube component 318, the actuator linkage 106, or any portion of the fluid path assembly 104, or any combination thereof). Further, the pistons 208 and 210 are positioned to the right (corresponding to the orientation of the pump assembly 100 as depicted in FIG. 9)—for example, nearer the arm 228. Accordingly, the piston plates 202 and 204 are shifted off-center to the right most travel position.

As further shown in FIG. 9, a first arm or end (a left arm corresponding to the orientation of the pump assembly 100 as depicted in FIG. 9; e.g., nearer the plate 202) 902 of the actuator linkage 105 can be coupled to the protrusion 216 of the plate 202. A second arm or end (a right arm corresponding to the orientation of the pump assembly 100 as depicted in FIG. 9; nearer the plate 204) 904 of the actuator linkage 106 can be coupled to the protrusion 222 of the plate 204. The actuator linkage 106 is also correspondingly shifted off-center to the right based on the positioning of the plates 202 and 204 (e.g., nearer the arm 228).

The bi-stable spring 214 is shown coupled to the extension 226 and is shown bent or curved in a first direction (e.g., to the left or toward the arm 226). The bi-stable spring 220 is shown coupled to the extension 228 and is shown bent or curved in the same direction as the bi-stable spring 214 (e.g., also to the left or toward the arm 226). The bi-stable springs 214 and 220 can initially resist movement of the plates 202 and 204 to the left (e.g., toward the arm 226) until a point of inflection at which point the curvature of the springs 214 and 220 can flip. In doing so, the bi-stable springs 214 and 220 can then help facilitate movement of the plates 202 and 204 to the left. In various embodiments, the initial resistance of the bi-stable springs 214 and 220 can be used to properly sequence the positioning of the tube 318.

Figure 10:
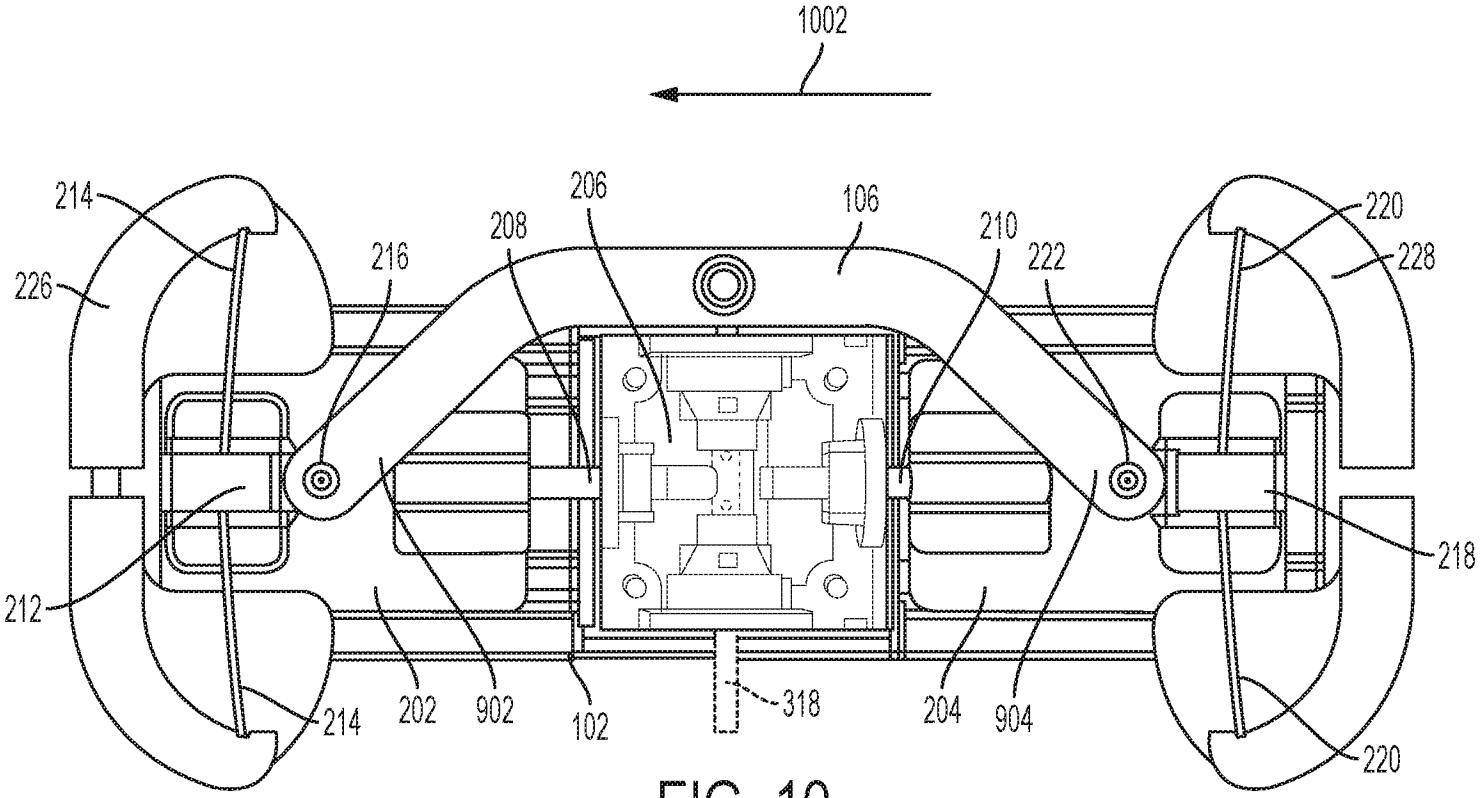
FIG. 10 illustrates a second stage of operation of the pump assembly depicted in FIGS. 1 and 2.

FIG. 10 illustrates a second stage of operation (subsequent to the stage of operation depicted in FIG. 9). This second operational state can correspond to the operational state of the components depicted in FIG. 6. As shown in FIG. 10, the plates 202 and 204 are moved in a direction 1002 (e.g., toward the arm 226; corresponding to the movement of the pistons 208 and 210 in the direction 602 as depicted in FIG. 6). The actuator linkage 106 can ensure the plates 202 and 204 move in unison. In various embodiments, the plates 202 and 204 can be actuated in response to actuation of the pistons 208 and 210, respectively. The pistons 208 and 210 can be actuated to a point where the states of the bi-stable springs 214 and 220 as shown in FIG. 9 toggle (i.e., change state) so as to help movement of the pistons in the direction 1002 and to no longer to resist such movement. As shown in FIG. 10, a curve or bend of each bi-stable springs 214 and 220 has changed (e.g., relative to the curve or bend of each bi-stable springs 214 and 220 depicted in FIG. 9; now facing toward arm 228)—indicating that the initial stable states of the bi-stable springs 214 and 222 have changed to a second stable state.

After reaching inflection, as mentioned, the bi-stable springs 214 and 222 can provide a force to complete movement of the pistons 208 and 210 to the positions shown in FIG. 6. The travel stop 232 (see FIG. 2; not shown in FIGS. 9-12) can stop further movement of the pistons 208 and 210 in the direction 1002. Further, the travel stop 232 can be electrically coupled to a controller or other electronic device and can indicate when the pistons 208 and 210 have reached their final position (in the direction 1002) based on contact with the piston 208 and/or the plate 202. The force of the bi-stable springs 214 and 222 can enable the initial actuation force to be lower.

Figure 11:
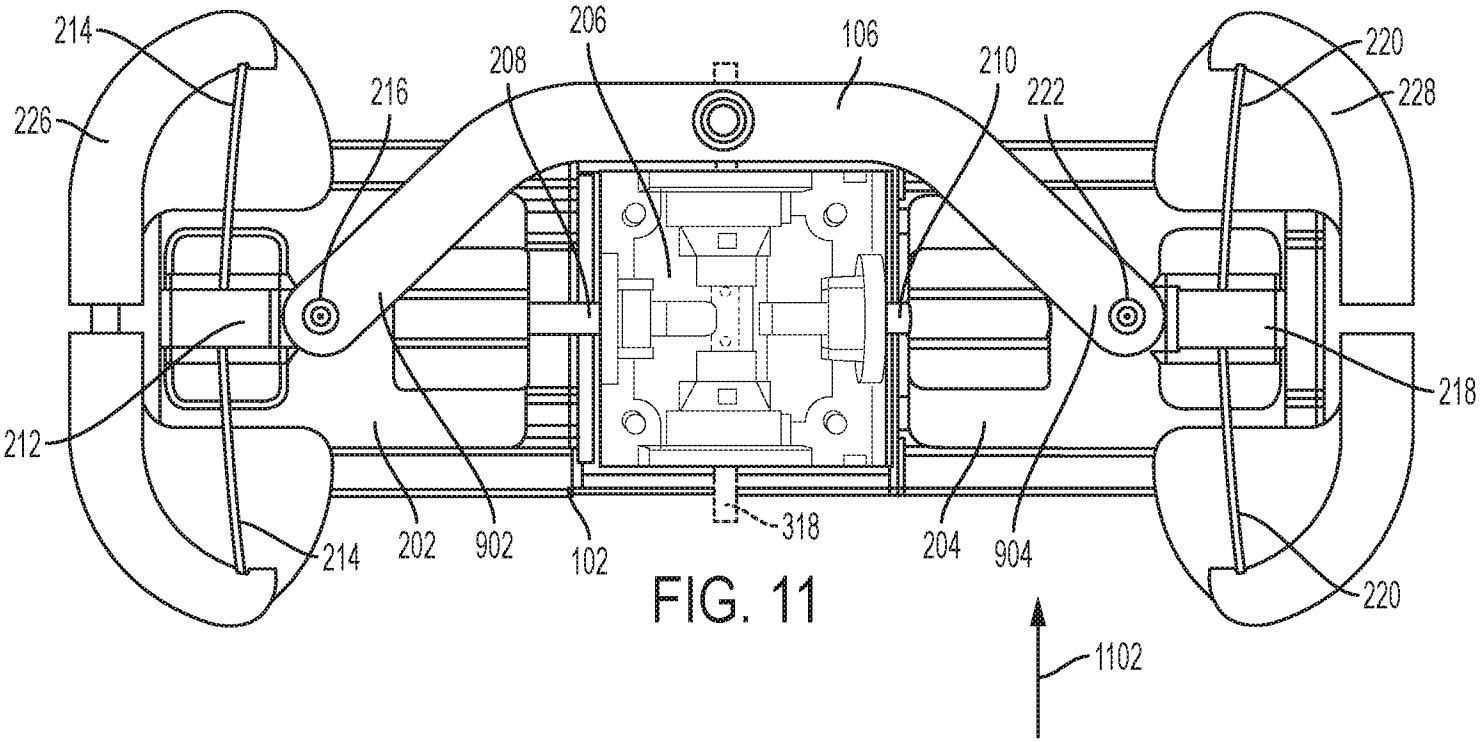
FIG. 11 illustrates a third stage of operation of the pump assembly depicted in FIGS. 1 and 2.

FIG. 11 illustrates a third stage of operation (subsequent to the stage of operation depicted in FIG. 10). This third operational state can correspond to the operational state of the components depicted in FIG. 7. As shown in FIG. 11, the tube component 318 is moved in a direction 1102 (corresponding to the movement of the tube component 318 in the direction 702 as depicted in FIG. 7). As shown, the plates 202 and 204 remain positioned off-center and to the left side of the base 102 (e.g., closer to the arm 226). In various embodiments, an actuator of the assembly of the assembly 100 can adjust the position of the tube component 318 prior to driving the linkage 106 and/or the pistons 208 and 210.

Figure 12:
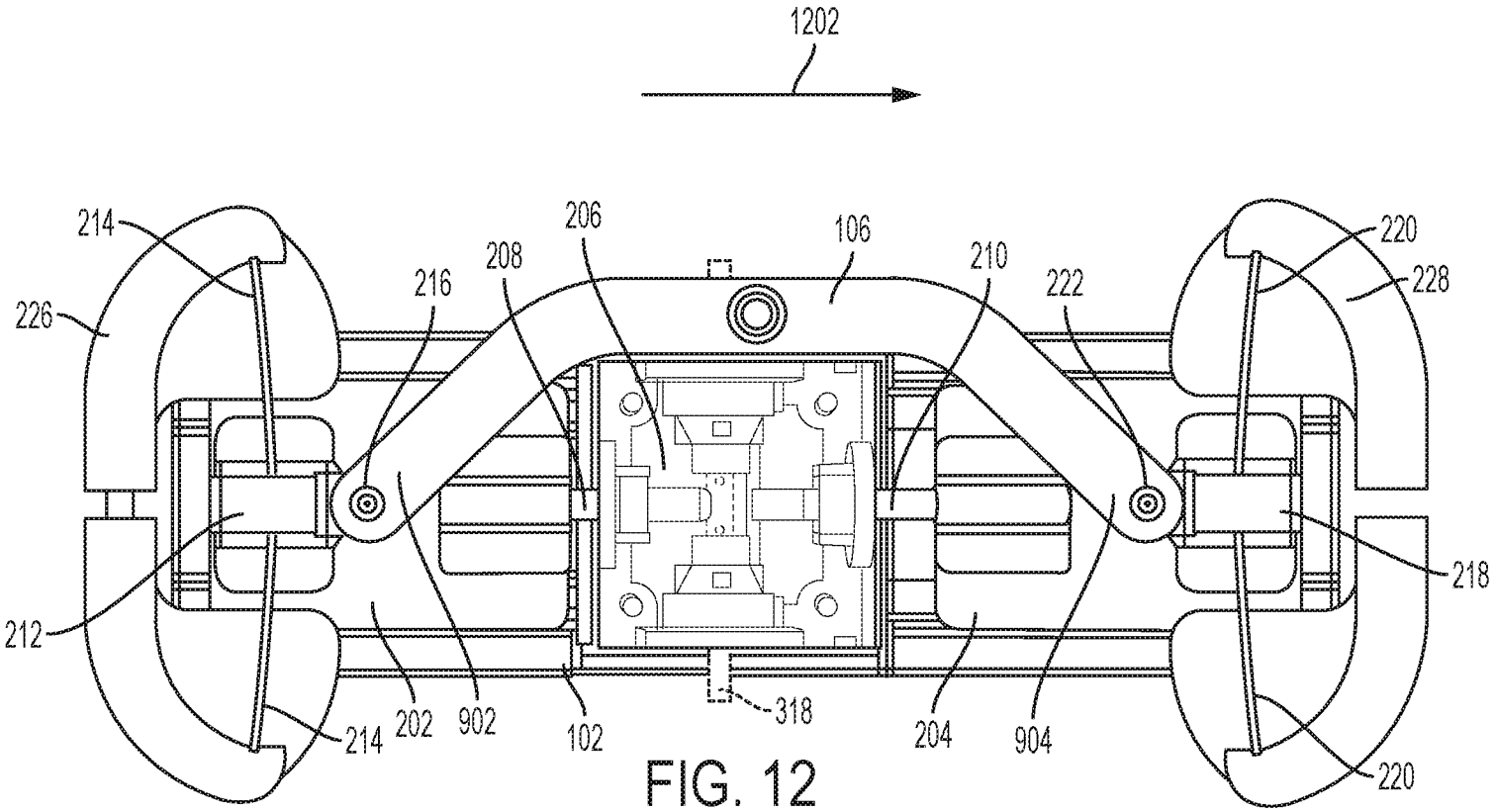
FIG. 12 illustrates a fourth stage of operation of the pump assembly depicted in FIGS. 1 and 2.

FIG. 12 illustrates a fourth stage of operation (subsequent to the stage of operation depicted in FIG. 10). This fourth operational state can correspond to the operational state of the components depicted in FIG. 8. As shown in FIG. 12, the plates 202 and 204 are moved in a direction 1202 (corresponding to the movement of the pistons 208 and 210 in the direction 802 as depicted in FIG. 8; toward the arm 228). The actuator linkage 106 can ensure the plates 202 and 204 move in unison. In various embodiment, the plates 202 and 204 can be actuated in response to actuation of the pistons 208 and 210, respectively.

The pistons 208 and 210 can be actuated to a point where the states of the bi-stable springs 214 and 220 as shown in FIG. 11 toggle (i.e., change state) so as to help movement of the pistons 208 and 210 in the direction 1202 and to no longer to resist such movement. As shown in FIG. 12, a curve or bend of each bi-stable springs 214 and 220 has changed (e.g., relative to the curve or bend of each bi-stable springs 214 and 220 depicted in FIG. 11; now facing the arm 226)—indicating that the second stable states of the bi-stable springs 214 and 222 have changed back to the first stable state (e.g., as shown in FIG. 9).

After reaching inflection, as mentioned, the bi-stable springs 214 and 222 can complete movement of the pistons 208 and 210 to the positions shown in FIG. 8. The travel stop 234 (see FIG. 2; not shown in FIGS. 9-12) can stop further movement of the pistons 208 and 210 in the direction 1202. Further, the travel stop 234 can be electrically coupled to a controller or other electronic device and can indicate when the pistons 208 and 210 have reached their final position (in the direction 1202; toward the arm 228).

As with the corresponding operations depicted with respect to FIGS. 5-8, the sequence of operations (e.g., operational states) depicted in FIGS. 9-12 can be repeated to implement a subsequent cycle of drawing in fluid through the inlet component 416 from a reservoir and pushing the fluid out through the outlet component 418 for delivery to a patient. The sequence of operations can be repeated any number of times to deliver any size of dose of a liquid drug to the user.

Figure 13A:
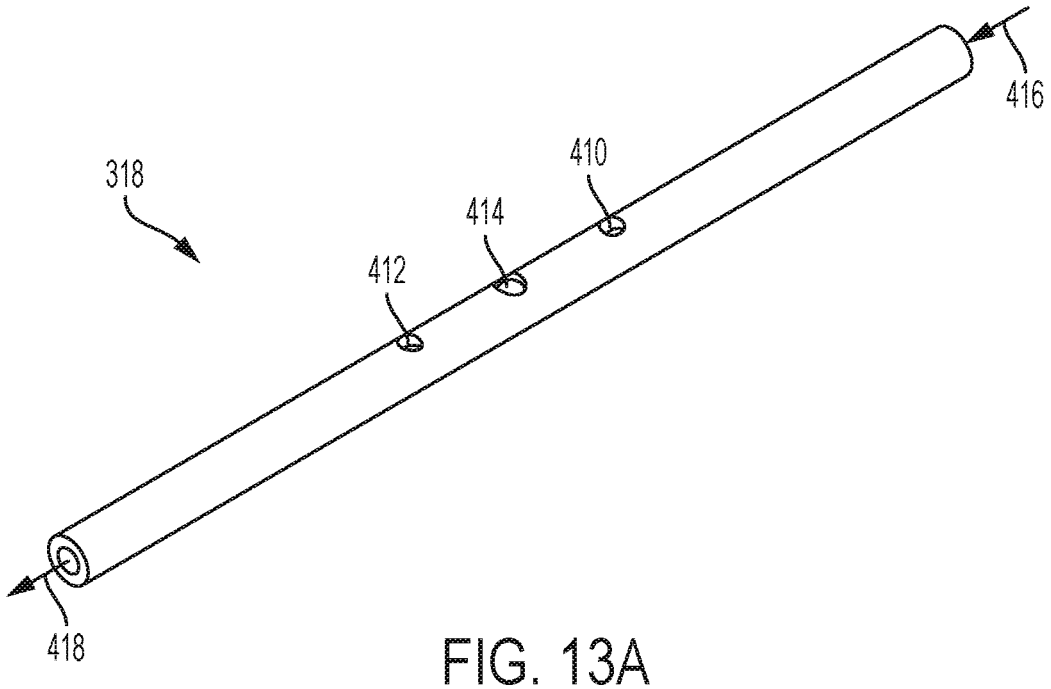
FIG. 13A illustrates an isometric view of a tube component depicted in FIG. 4.

FIG. 13A illustrates an isometric view of the tube component 318. As shown, the center plug 414 is positioned between the side port 410 and the side port 412. The side port 410 can be coupled to the inlet component 416 and the side port 412 can be coupled to the outlet component 418 as shown. The center plug 414 can prevent leaking between the inlet component 416 and the outlet component 418.

Figure 13B:
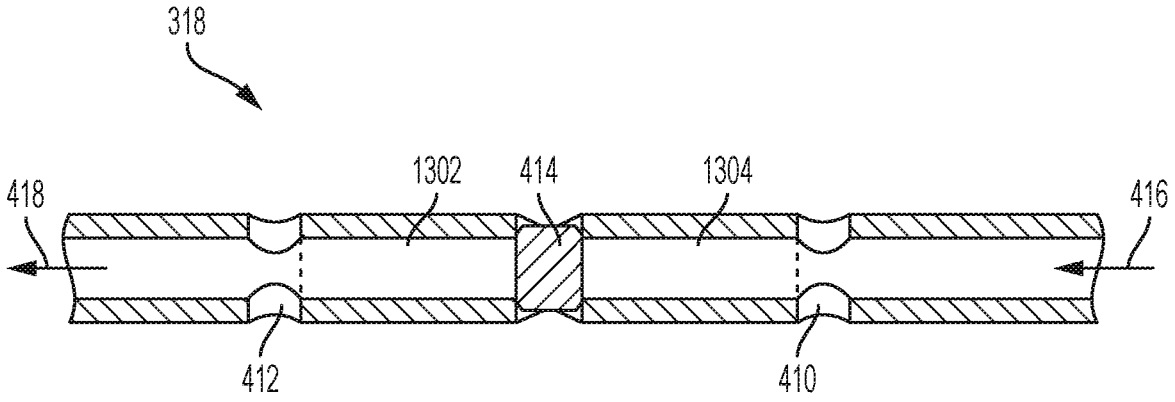
FIG. 13B illustrates a cross-sectional side view of the tube component depicted in FIG. 13A.

FIG. 13B illustrates a cross-sectional side view of the tube component 318. As shown, the center plug 414 isolates the inlet component 416 from the outlet component 418. The side ports 412 and 414 can be formed, for example, by cross-drilling. In various embodiments, a first region 1302 between the side port 412 and the center plug 414 can also be filled or filled in (e.g., to form or be coupled to the center plug 414) and/or a second region 1304 between the side port 410 and the center plug 414 can also be filled or filled in (e.g., to form or be coupled to the center plug 414).

In various embodiments, the side ports 410 and 412 can be formed using a grinding method, a laser cutting process, or a machining process, or may be part of the original forming process for the tube component 318 (e.g., by a molding process). In various embodiments, the center plug 414 can be installed into the tube component 318 as a separate piece or component from the tube component 318 or can be formed through any individual or combination of a spot-weld process, crimping process, swaging process, or filling/plugging process. In various embodiments, the tube component 318 can be formed of two or more tubes. For example, the tube component 318 can be formed of two separate tubes having end caps joined together to form the center plug 414 and capable of moving together as a single component. In other embodiments, the tube component 318 can be formed of two separate tubes that are not joined.

Figure 14A:
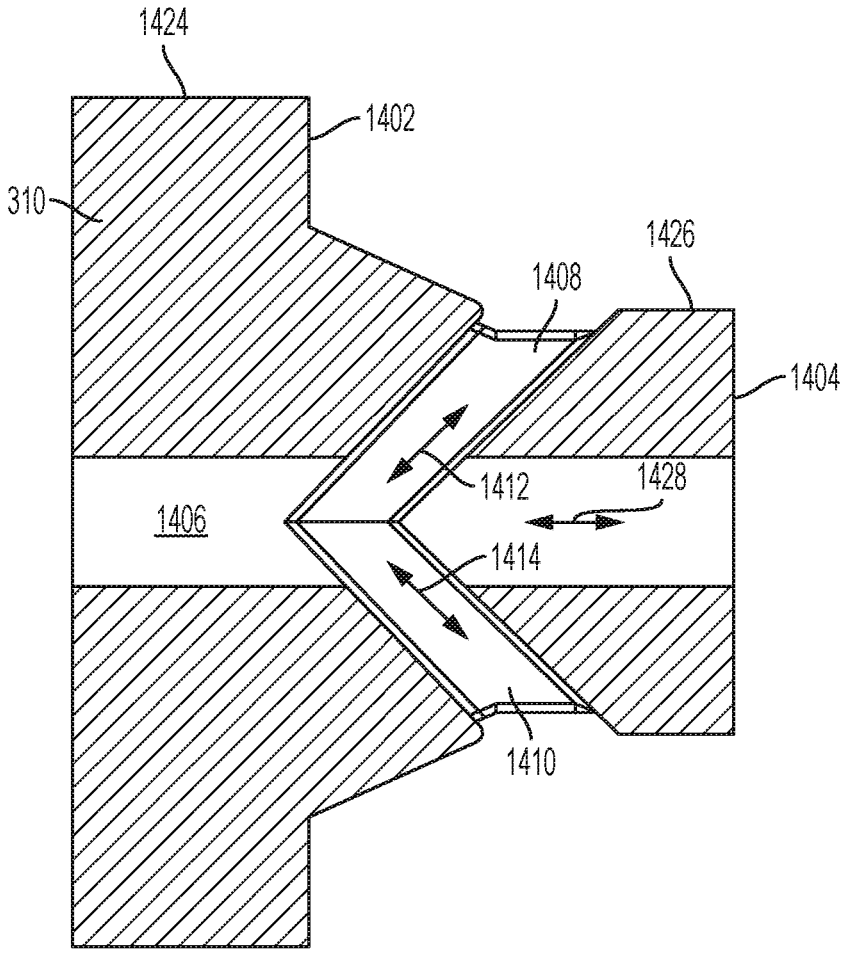
FIG. 14A illustrates a cross-sectional side view of a first exemplary septum of the fluid path assembly depicted in FIG. 3.

FIG. 14A illustrates a cross-sectional side view of a first exemplary septum of the pump assembly 100—for example, the septum 310 depicted in FIG. 3. As shown in FIG. 14A, the septum 310 can include a first face seal 1402 (e.g., to the pump block 206) and a second face seal 1404 (also to the pump block 206). Further, the septum 310 can include an inner open area or channel 1406 as well as a first angled opening or channel 1408 and a second angled opening or channel 1410 coupled to the inner channel 1406. The tube component 318 can be positioned though the channel 1406 (and/or can pierce through the septum 310 in an area shown by the channel 1406). Fluid can flow bidirectionally through the channel 1408 as indicated by flow indicator 1412 into the side ported tube 318 depending on the position of the tube 318. Similarly, fluid can flow bidirectionally through the channel 1410 as indicated by flow indicator 1414 into the side ported tube 318 depending on the position of the tube 318.

Further, fluid can flow bidirectionally through the channel 1406 as indicated by flow indicator 1428. The channels 1408 and 1410 can be coupled to one of the annual fluid chambers 424 or 426 to provide fluid communication with the channel 408. This arrangement can provide the cross ported feature of the septa 310 described herein. The septum 310 can further include a first radial seal 1424 (e.g., to the pump block 206) and a second radial seal 1426 (also to the pump block 206).

Figure 14B:
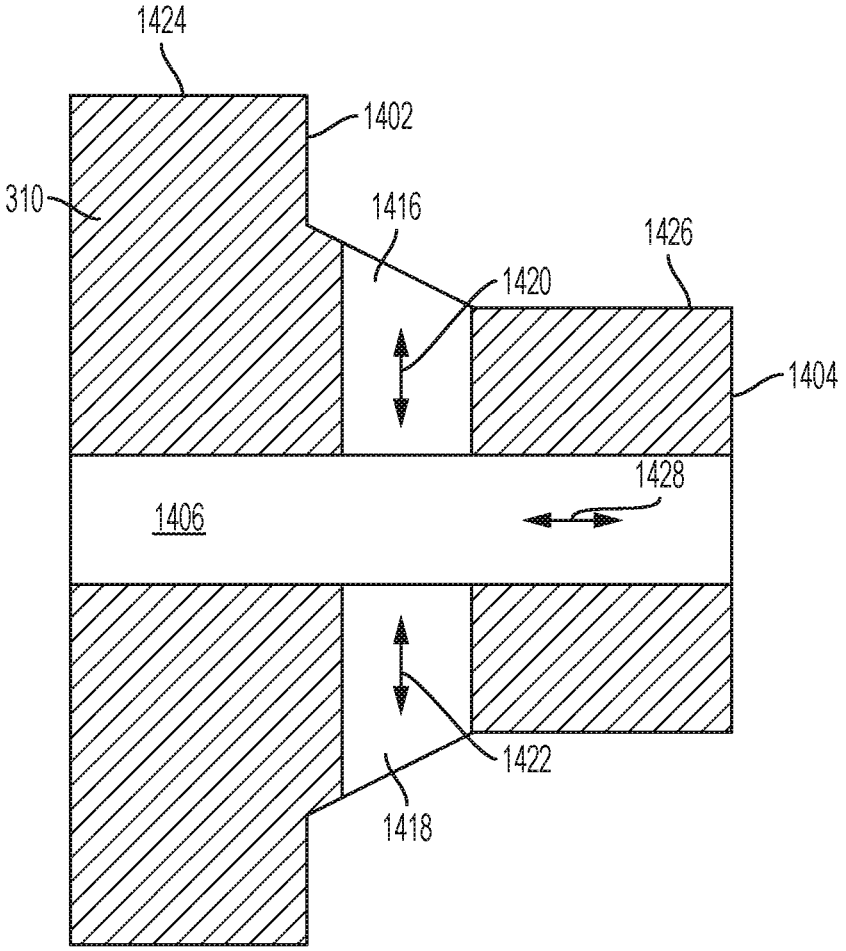
FIG. 14B illustrates a cross-sectional side view of a second exemplary septum of the fluid path assembly depicted in FIG. 3.

FIG. 14B illustrates a cross-sectional side view of a second exemplary septum of the pump assembly 100—for example, the septum 310 depicted in FIG. 3. In contrast to the exemplary septum depicted in FIG. 14A having angled channels, the exemplary septum depicted in FIG. 14B can include a first straight opening or channel 1416 and a second straight opening or channel 1418 coupled to the inner channel 1406. The tube component 318 can be positioned though the channel 1406 (and/or can pierce through the septum 310 in an area shown by the channel 1406). Fluid can flow bidirectionally through the channel 1416 as indicated by flow indicator 1420 into the side ported tube 318 depending on the position of the tube 318. Similarly, fluid can flow bidirectionally through the channel 1418 as indicated by flow indicator 1422 into the side ported tube 318 depending on the position of the tube 318. Fluid can also from through the channel 1406 as shown by the flow indictor 1428. Similar to the arrangement shown in FIG. 14A, the channels 1416 and 1418 provide fluid communication with either the annual fluid chamber 424 or 426 and, in turn, the channel 408.

Figure 15:
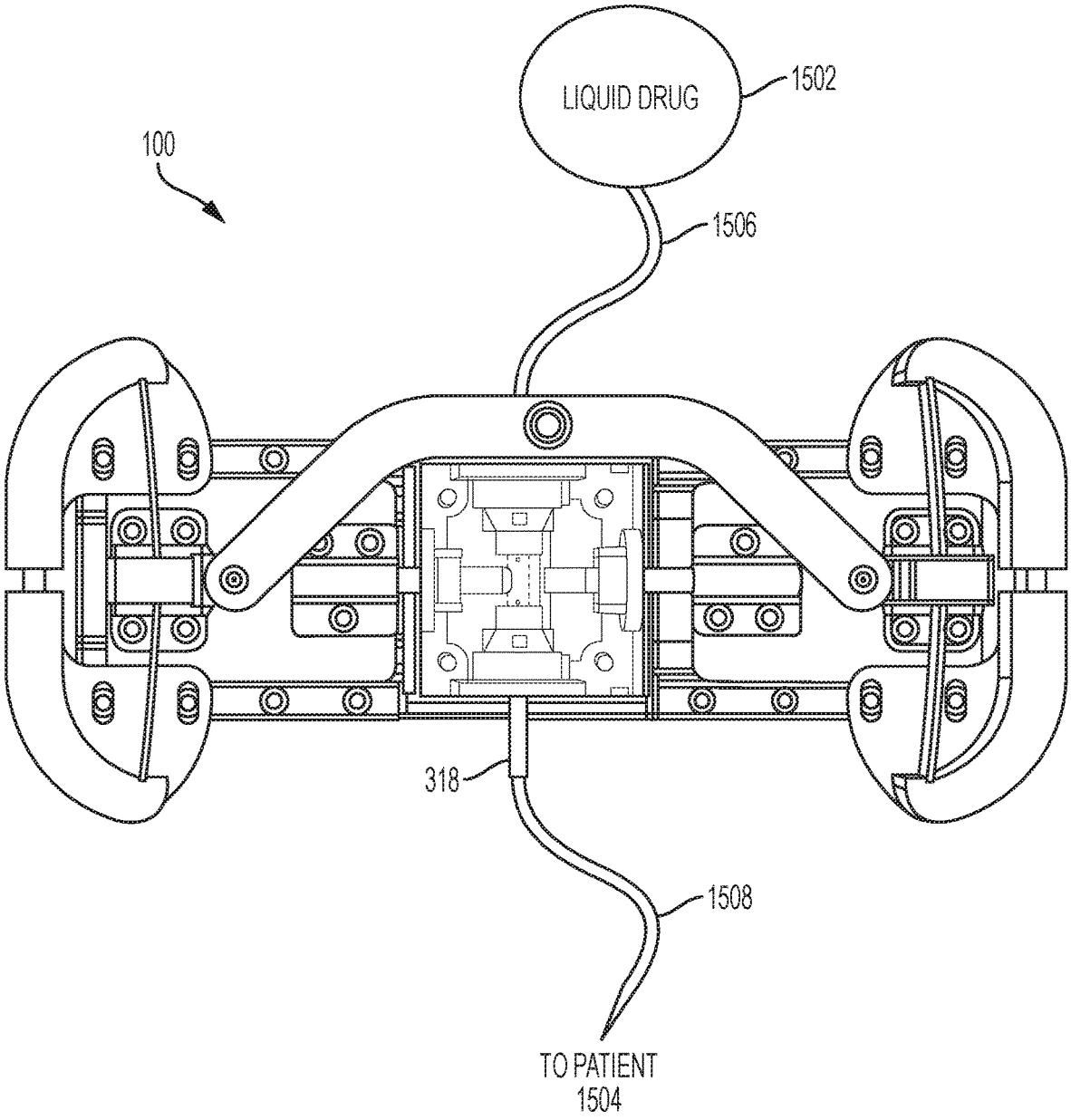
FIG. 15 illustrates an exemplary arrangement of the pump assembly depicted in FIGS. 1 and 2 coupled to a reservoir and coupled to a patient.

FIG. 15 illustrates an exemplary arrangement of the pump assembly 100 coupled to a reservoir 1502 and coupled to a user or patient 1504. The reservoir 1502 can store any liquid drug or therapeutic agent. The reservoir 1502 can be coupled to the inlet component 416 of the tube component 318. The reservoir 1502 can be coupled to the inlet component 416 by a fluid path component 1506. The fluid path component 1506 can be any type of fluid connection such as a tubing component or other tubing made from any type of suitable material. The reservoir 1502 can be a rigid reservoir (e.g., a hard cartridge), a semi-rigid reservoir, or a flexible reservoir (e.g., a bag).

The user 1504 can be coupled to the outlet component 416 of the tube component 318. The user 1504 can be coupled to the outlet component 416 by a fluid path component 1508. The fluid path component 1508 can be any type of fluid connection such as a tubing component or other tubing made from any type of suitable material. In various embodiments, the fluid path component 1508 can include a cannula. As shown in FIG. 15, the pump assembly 100 can be used to deliver a liquid drug stored in the reservoir 1502 to the user 1504.

The pump assembly 100, including the arrangement of the pump assembly 100 depicted in FIG. 15, can be part of or included within a drug delivery device or system including, for example, a wearable drug delivery device. In various embodiments, the drug delivery device can be a disposable device and can be prefilled with a liquid drug such as, for example, insulin.

The pump assembly 100, including the valve system depicted in FIG. 4, can be made small and compact while not sacrificing quality or durability. This enables the embodiments disclosed herein to have a small form factor to enable any device or system in which it is used to also remain small and comfortable to a user. Additionally, the radial sealing used by the valve system depicted in FIG. 4 can provide reliable seals that are not adversely affected by the actuation of the pistons 208 and 210, thereby providing reliable operation on a micro scale.

The pump assembly 100 and/or any component thereof can be actuated by any suitable means including, for example, using a motor or a shape-memory alloy (SMA) wire actuator. In general, the pistons 208 and 210 can be actuated with the other components coupled thereto reacting to the actuation or the arms 226 and 228 or the plates 202 and 204 can be actuated causing components thereto to move in response. In various embodiments, the actuator linkage 106 and/or the piston plates 202 and 204 can be alternatively actuated to initiate movement.

Figure 16:
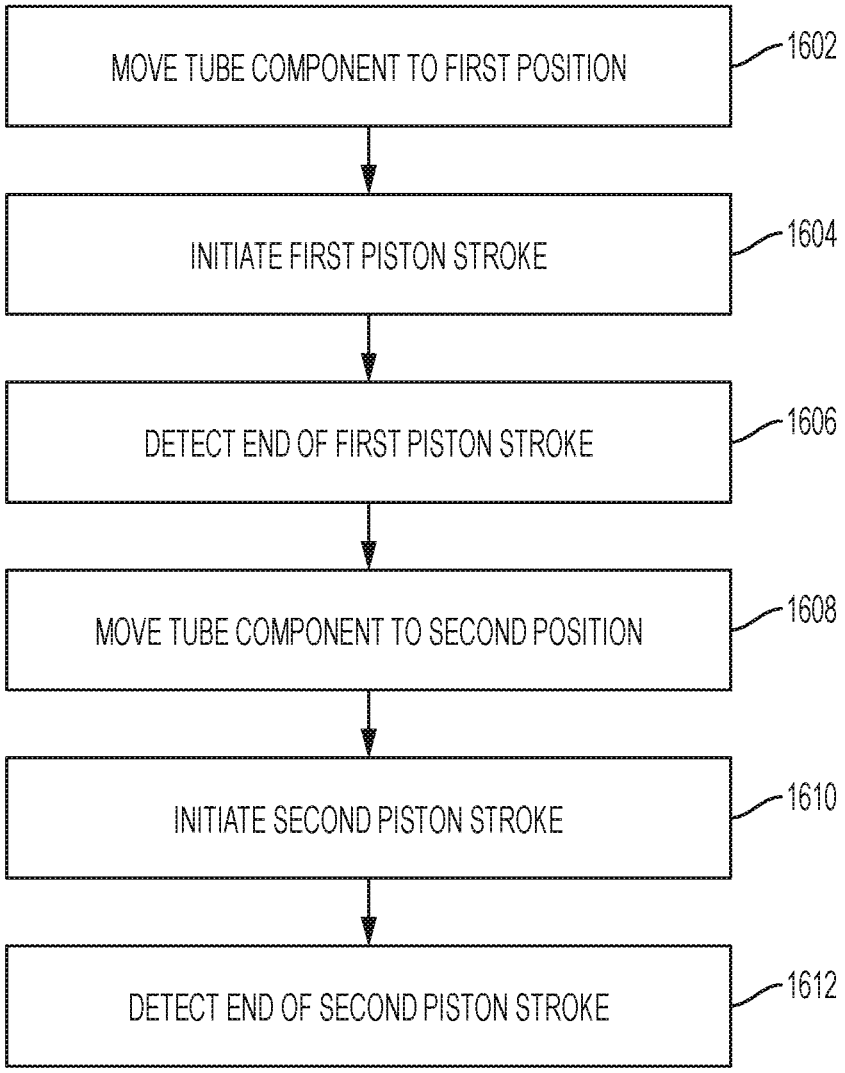
FIG. 16 illustrates a method of operation for the pump assembly depicted in FIG. 1.

FIG. 16 illustrates an exemplary method of operation 1600 for a pump assembly. The method of operation 1600 can be implemented by the pump assembly 1600 using the valve system depicted in detail in FIG. 4.

At 1602, a tube component positioned within a pump block can be moved to a first position. In doing so, a first opening within the tube component is coupled to a first piston pump chamber of the pump block. Further, a second opening in the tube component is coupled to a second piston pump chamber of the pump block.

At 1604, a first piston stroke for first and second pistons can be initiated. The first piston can be positioned within the first piston pump chamber. The second piston can be positioned within the second piston pump chamber. The first piston stroke can be initiated by actuating the first and second pistons (or a component or components coupled thereto) to move linearly in a first direction within the first and second piston pump chambers, respectively. The first piston stroke can draw in a first portion of a fluid into the first piston chamber through the first opening in the tube component. Further, the first piston stroke can expel a second portion of the fluid already stored in the second piston chamber through the second opening in the tube component.

At 1606, an end of the first piston stroke can be detected. The end of the first piston stroke can be determined based on the first piston contacting one or more first conductive travel stops.

At 1608, the tube component can be moved to a second position. In doing so, the first opening within the tube component is coupled to the second piston pump chamber of the pump block. Further, the second opening in the tube component is coupled to the first piston pump chamber of the pump block.

At 1610, a second piston stroke for the first and second pistons can be initiated. The second piston stroke can be initiated by actuating the first and second pistons to move linearly in a second, opposite direction. The second piston stroke can draw in a third portion of the fluid into the second piston chamber through the first opening in the tube component. Further, the second piston stroke can expel the first portion of the fluid in the first piston chamber through the second opening in the tube component.

At 1612, an end of the second piston stroke can be detected. The end of the second piston stroke can be determined based on the second piston contacting one or more second conductive travel stops.

The method of operation 1600 can be repeated to initiate subsequent operations of the pump assembly to draw fluid into and expel fluid out of the valve body within the pump assembly 100. As previously mentioned, the tube component can include an inlet portion for drawing in the fluid from a reservoir and can include an outlet portion for expelling the fluid to a fluid path (e.g., a cannula) for delivery to a patient.

In various embodiments, the valve and/or pump systems described herein (e.g., the portion of the pump assembly 100 depicted in FIG. 4), the tube component (e.g., the tube component 318) can held stationary and the valve body (e.g., the valve body 206) can be moved. In various embodiments, the pump assembly 100 can be operated by detecting valve coupling and/or operation states (e.g., a position of the first and second pistons 208 and 210 relative to one another and/or the piston chambers 402 and 404, respectively) to determine when to actuate and/or when to draw in or expel fluid from one of the piston chambers 402 and 404.

In various embodiments, the valve and/or pump systems described herein (e.g., the portion of the pump assembly 100 depicted in FIG. 4) can include only a single piston and pump chamber and can operate to draw in fluid from an external reservoir and to expel the fluid to a cannula. For example, the valve body 206 can be modified to include a single piston (e.g., the piston 208) and a single corresponding piston chamber (e.g., the piston chamber 402). The piston chamber 402 can be alternately/selectively coupled to the inlet 416 through the port 410 and the outlet 418 through the port 412. The piston 208 can be actuated to draw in a fluid to the piston chamber 402 and to expel the fluid from the piston chamber 402. One skilled in the art will appreciate operation of such a valve assembly in view of the description of the valve assemblies described herein.

In various embodiments, the valving of the assembly 100 (and/or actuation of the pistons 208 and 210) is not limited to movement in a linear direction. Translational movement of the valving and/or positions 208 and 210 can also be implemented.

The following examples pertain to further embodiments:

Example 1 is a pump system comprising a piston pump block, a first septum positioned within the piston pump block, a second septum positioned within the piston pump block and aligned with the first septum, a first piston configured to move within a first piston pump chamber, the first piston and the first piston pump chamber positioned on a first side of the aligned first and second septa, a second piston configured to move within a second piston pump chamber, the second piston and the second piston pump chamber positioned on a second, opposite side of the aligned first and second septa, a tube component positioned through the piston pump block, the first septum, and the second septum and positioned between the first and second pistons and the first and second piston pump chambers, wherein the tube component comprises a first side port, a second side port, and a center plug positioned between the first and second side ports, the first side port coupled to an inlet component portion of the tube component and the second side port coupled to an outlet component portion of the tube component, wherein the tube component is selectively moved to couple the first side port to the first piston pump chamber and the second side port to the second piston pump chamber or to couple the first side port to the second piston pump chamber and the second side port to the first piston pump chamber, wherein the first and second pistons are selectively moved to draw in a fluid to the first piston pump chamber from the inlet component portion and to expel the fluid from the second piston pump chamber through the outlet component portion when the first side port is coupled to the first piston pump chamber and the second side port is coupled to the second piston pump chamber or to draw in the fluid to the second piston pump chamber and to expel the fluid from the first piston pump chamber when the first side port is coupled to the second piston pump chamber and the second side port is coupled to the first piston pump chamber.

Example 2 is an extension of Example 1 or any other example disclosed herein, wherein the first septum and the second septum are aligned along a first central axis of the pump system.

Example 3 is an extension of Example 1 or any other example disclosed herein, wherein the first and second pistons and the first and second piston pump chambers are aligned along a second central axis of the pump system, wherein the second central axis is perpendicular is to the first central axis.

Example 4 is an extension of Example 3 or any other example disclosed herein, wherein during a first stage of operation, the tube component is moved to couple the first side port to the first piston pump chamber and to couple the second side port to the second piston pump chamber.

Example 5 is an extension of Example 4 or any other example disclosed herein, wherein during a second stage of operation, the first and second pistons are moved in a first direction along the second central axis to draw the fluid into the first piston pump chamber from the first side port and the inlet component portion and to expel the fluid from the second piston pump chamber through the second side port and the outlet component portion.

Example 6 is an extension of Example 5 or any other example disclosed herein, wherein during a third stage of operation, the tube component is moved to couple first side port to the second piston pump chamber and to couple the second side port to the first piston pump chamber.

Example 7 is an extension of Example 6 or any other example disclosed herein, wherein during a fourth stage of operation, the first and second pistons are moved in a second, opposite direction along the central axis to draw the fluid into the second piston pump chamber from the first side port and the inlet component portion and to expel the fluid from the first piston pump chamber through the second side port and the outlet component portion.

Example 8 is an extension of Example 7 or any other example disclosed herein, wherein the tube is moved along a direction parallel to the first central axis.

Example 9 is an extension of Example 8 or any other example disclosed herein, further comprising a first channel positioned between the first septum and the second septum and coupled to the first piston pump chamber.

Example 10 is an extension of Example 9 or any other example disclosed herein, further comprising a second channel positioned between central portions of the first septum and the second septum and coupled to the second piston pump chamber.

Example 11 is an extension of Example 10 or any other example disclosed herein, further comprising a pump base, the piston pump block positioned on the pump base.

Example 12 is an extension of Example 11 or any other example disclosed herein, further comprising a first piston plate coupled to the first piston and a second piston plate coupled to the second piston.

Example 13 is an extension of Example 12 or any other example disclosed herein, further comprising a linkage actuator component coupled to the first piston plate and the second piston plate.

Example 14 is an extension of Example 13 or any other example disclosed herein, wherein the first piston plate comprises a first bi-stable spring coupled to a first extension component of the pump base and the second piston plate comprises a second bi-stable spring coupled to a second extension component of the pump base.

Example 15 is an extension of Example 14 or any other example disclosed herein, wherein the first and second bi-stable springs switch from a first stable state to a second state when the pistons are moved in the first direction and switch from the second stable state to the first stable state when the pistons are moved in the second, opposite direction.

Example 16 is an extension of Example 12 or any other example disclosed herein, wherein the pump base further comprises a first travel stop and a second travel stop, the first travel stop configured to block further movement of the first piston in the first direction after the first and second pistons are moved by a full stroke in the first direction, the second travel stop configured to block further movement of the second piston in the second, opposite direction after the first and second pistons are moved by the full stroke in the second, opposite direction.

Example 17 is an extension of Example 16 or any other example disclosed herein, wherein the first and second travel stops are conductive.

Example 18 is an extension of Example 17 or any other example disclosed herein, wherein a position of the first and second pistons is provided based on the first piston contacting the first travel stop or the second piston contacting the second travel stop.

Example 19 is an extension of Example 1 or any other example disclosed herein, wherein the inlet component portion is coupled to a reservoir storing the fluid.

Example 20 is an extension of Example 1 or any other example disclosed herein, wherein the outlet component portion is coupled to a cannula.

Example 21 is a method comprising coupling a first opening in a tube component to a first piston chamber, coupling a second opening in the tube component to a second piston chamber, moving a first piston within the first piston chamber in a first direction to draw in a first portion of a fluid into the first piston chamber through the first opening in the tube component, and moving a second piston within the second piston chamber in the first direction to expel a second portion of the fluid from the second piston chamber through the second opening in the tube component.

Example 22 is an extension of Example 21 or any other example disclosed herein, further comprising coupling a first end of the tube component closest to the first opening to a reservoir storing the fluid.

Example 23 is an extension of Example 22 or any other example disclosed herein, further comprising coupling a second end of the tube component closest to the second opening to a cannula.

Example 24 is an extension of Example 21 or any other example disclosed herein, further comprising coupling the first opening in the tube component to the second piston chamber, coupling the second opening in the tube component to the first piston chamber, moving the first piston within the first piston chamber in a second, opposite direction to expel the first portion of the fluid from the first piston chamber through the second opening in the tube component, and moving the second piston within the second piston chamber in the second, opposite direction to draw in a third portion of the fluid into the second piston chamber through the first opening in the tube component.

Example 25 is a pump system comprising a piston pump block, a first septum positioned within the piston pump block, a second septum positioned within the piston pump block and aligned with the first septum, a piston configured to move within a piston pump chamber, the piston and the piston pump chamber positioned on a first side of the aligned first and second septa, a tube component positioned through the piston pump block, the first septum, and the second septum, wherein the tube component comprises a first side port, a second side port, and a center plug positioned between the first and second side ports, the first side port coupled to an inlet component portion of the tube component and the second side port coupled to an outlet component portion of the tube component, wherein the tube component is selectively moved to couple the first side port or the second side port to the piston pump chamber, wherein the piston is selectively moved to draw in a fluid to the piston pump chamber from the inlet component portion when the first side port is coupled to the piston pump chamber or to expel the fluid from the piston pump chamber when the second side port is coupled to the piston pump chamber.

Example 26 is a method comprising coupling a first opening in a tube component to a piston chamber, moving a piston within a piston chamber in a first direction to draw in a first portion of a fluid into the piston chamber through the first opening in the tube component, coupling a second opening in the tube component to the piston chamber, moving the piston within the piston chamber in a second, opposite direction to expel the first portion of the fluid from the piston chamber through the second opening in the tube component.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

The invention claimed is:

1. A drug delivery device, comprising:

a reservoir configured to store a liquid drug;

a fluid path component configured to be coupled to a patient; and a pump system coupled to the reservoir and to the fluid path component, the pump system including:

a piston pump block;

a first septum positioned within the piston pump block;

a second septum positioned within the piston pump block, wherein the first septum and the second septum are fitted into open areas of the piston pump block;

a first piston configured to move within a first piston pump chamber, the first piston and the first piston pump chamber positioned on a first side of the first and second septa;

a second piston configured to move within a second piston pump chamber, the second piston and the second piston pump chamber positioned on a second, opposite side of the first and second septa; and a tube component extending through the piston pump block, the first septum, and the second septum and positioned between the first and second pistons and the first and second piston pump chambers, wherein the tube component comprises a first side port, a second side port, and a center plug positioned between the first and second side ports, the first side port coupled to an inlet component portion of the tube component and the second side port coupled to an outlet component portion of the tube component, wherein the tube component is selectively moved to couple the first side port to the first piston pump chamber and the second side port to the second piston pump chamber or to couple the first side port to the second piston pump chamber and the second side port to the first piston pump chamber, and wherein the first and second pistons are selectively moved to draw in the liquid drug from the reservoir to the first piston pump chamber from the inlet component portion and to expel the liquid drug from the second piston pump chamber through the outlet component portion to the fluid path component when the first side port is coupled to the first piston pump chamber and the second side port is coupled to the second piston pump chamber or to draw in the liquid drug from the reservoir to the second piston pump chamber and to expel the liquid drug from the first piston pump chamber to the fluid path component when the first side port is coupled to the second piston pump chamber and the second side port is coupled to the first piston pump chamber.

2. The drug delivery device of claim 1, further comprising a first channel positioned between the first septum and the second septum and coupled to the first piston pump chamber.

3. The drug delivery device of claim 2, further comprising a second channel positioned between central portions of the first septum and the second septum and coupled to the second piston pump chamber.

4. The drug delivery device of claim 1, wherein the inlet component portion is coupled to the reservoir storing the liquid drug.

5. The drug delivery device of claim 4, wherein the outlet component portion is coupled to a cannula.

6. The drug delivery device of claim 1, further comprising a first piston plate coupled to the first piston and a second piston plate coupled to the second piston.

7. The drug delivery device of claim 6, further comprising a linkage actuator component coupled to the first piston plate and the second piston plate.

8. The drug delivery device of claim 7, wherein the first piston plate comprises a first bi-stable spring coupled to a first extension component of a pump base and the second piston plate comprises a second bi-stable spring coupled to a second extension component of the pump base.

9. The drug delivery device of claim 8, wherein the first and second bi-stable springs switch from a first stable state to a second state when the first and second pistons are moved in a first direction along a first central axis of the pump system and switch from the second stable state to the first stable state when the first and second pistons are moved in a second, opposite direction.

10. The drug delivery device of claim 1, further comprising a pump base, and the piston pump block positioned on the pump base.

11. The drug delivery device of claim 10, wherein the pump base further comprises a first travel stop and a second travel stop, the first travel stop configured to block further movement of the first piston in a first direction along a first central axis of the pump system after the first and second pistons are moved by a full stroke in the first direction, the second travel stop configured to block further movement of the second piston in a second, opposite direction from the first direction after the first and second pistons are moved by the full stroke in the second, opposite direction.

12. The drug delivery device of claim 11, wherein the first and second travel stops are conductive.

13. The drug delivery device of claim 12, wherein a position of the first and second pistons is provided based on the first piston contacting the first travel stop or the second piston contacting the second travel stop.

14. The drug delivery device of claim 1, further comprising: a first central axis of the pump system, wherein the first septum and the second septum are aligned along a second central axis of the pump system and the second central axis of the pump system is perpendicular to the first central axis of the pump system.

15. The drug delivery device of claim 14, wherein the first and second pistons and the first and second piston pump chambers are aligned along the first central axis of the pump system.

16. The drug delivery device of claim 15, wherein during a first stage of operation, the tube component is moved to couple the first side port to the first piston pump chamber and to couple the second side port to the second piston pump chamber.

17. The drug delivery device of claim 16, wherein during a second stage of operation, the first and second pistons are moved in a first direction along the first central axis of the pump system to draw the liquid drug into the first piston pump chamber from the first side port and the inlet component portion and to expel the liquid drug from the second piston pump chamber through the second side port and the outlet component portion.

18. The drug delivery device of claim 17, wherein during a third stage of operation, the tube component is moved in a first direction parallel to the second central axis of the pump system to couple the first side port to the second piston pump chamber and to couple the second side port to the first piston pump chamber.

19. The drug delivery device of claim 18, wherein during a fourth stage of operation, the first and second pistons are moved in a second, opposite direction along the first central axis of the pump system to draw the liquid drug into the second piston pump chamber from the first side port and the inlet component portion and to expel the liquid drug from the first piston pump chamber through the second side port and the outlet component portion.

20. The drug delivery device of claim 19, wherein the tube component is moved along a second direction parallel to the second central axis of the pump system, wherein the second direction of the tube component is opposite to the first direction of the tube component.

* * * * *